US008540119B2

(12) United States Patent
Gunstad et al.

(10) Patent No.: US 8,540,119 B2
(45) Date of Patent: Sep. 24, 2013

(54) DEVICE FOR DISPENSING GRANULAR FOOD PRODUCTS AND AN INSERT TO BE INSERTED IN A DEVICE FOR DISPENSING GRANULAR FOOD PRODUCTS

(75) Inventors: Frida Gunstad, Vasteras (SE); Mikael Gunstad, Arvika (SE); Fredrik Junkell, Ljungsarp (SE)

(73) Assignee: Click Candy AB, Arvika (SE)

( * ) Notice: Subject to any disclaimer, the term of this patent is extended or adjusted under 35 U.S.C. 154(b) by 0 days.

(21) Appl. No.: 13/500,343

(22) PCT Filed: Oct. 13, 2010

(86) PCT No.: PCT/SE2010/051104

§ 371 (c)(1),
(2), (4) Date: Apr. 5, 2012

(87) PCT Pub. No.: WO2011/046501

PCT Pub. Date: Apr. 21, 2011

(65) Prior Publication Data

US 2012/0199606 A1 Aug. 9, 2012

(30) Foreign Application Priority Data

Oct. 13, 2009 (SE) ..... 0950757
May 17, 2010 (SE) ..... 1050482

(51) Int. Cl.
*B67D 1/00* (2006.01)

(52) U.S. Cl.
USPC ..... 222/63; 222/52; 222/77; 222/167; 222/236; 222/333; 426/115

(58) Field of Classification Search
USPC ..... 222/52, 63, 77, 160, 162, 164, 166–167, 222/236, 241, 333, 367, 410, 412–413; 426/115
See application file for complete search history.

(56) References Cited

U.S. PATENT DOCUMENTS 3,581,949 A * 6/1971 Conrad et al. ..... 222/167
3,979,026 A * 9/1976 Lee ..... 222/167

(Continued)

FOREIGN PATENT DOCUMENTS

DE 2822581 A1 11/1979
EP 1650536 A2 4/2006

(Continued)

OTHER PUBLICATIONS

International Search Report and Written Opinion (mailed Nov. 12, 2010).

*Primary Examiner* — Frederick C Nicolas
(74) *Attorney, Agent, or Firm* — Jeffrey S. Melcher; Manelli Selter PLLC

(57) ABSTRACT

The invention relates to a device 1 for dispensing bulk candy. The device 1 comprises a container 3 which at one end 5 of the container 3 has a dispensing opening 14 through which candy/sweets can leave the container 3. The container 3 has an inside that is provided with at least one guide for the candy/the sweets. The guide or guides 17, 18, 19, 27 is/are arranged to guide sweets in a direction towards the dispensing opening when the container 3 rotates about its longitudinal axis. The container 3 is inclined in relation to the horizontal plane by an angle that may be in the range of 10°-25°. The guide or guides is/are arranged in the container 3 in such a way that sweets are guided in a direction towards the dispensing opening 14 when the container 3 rotates about its longitudinal axis but remains at rest when the container is at a standstill. The invention also relates to an insert that comprises a container 3 filled with sweets/candy and which can be loaded as a cartridge into a dispensing device for candy.

20 Claims, 23 Drawing Sheets

(56) References Cited

U.S. PATENT DOCUMENTS

| | | | | |
|---|---|---|---|---|
| 4,173,239 | A * | 11/1979 | Reiche | 144/341 |
| 4,311,257 | A | 1/1982 | Grieco | |
| 5,054,657 | A | 10/1991 | Morse | |
| 7,111,581 | B2 * | 9/2006 | Kubala et al. | 119/53.5 |
| 7,624,773 | B2 * | 12/2009 | Maxwell | 141/114 |
| 2007/0080175 | A1 | 4/2007 | Petersen | |
| 2008/0156395 | A1 | 7/2008 | Janardhanam | |
| 2008/0290107 | A1 | 11/2008 | Lock | |
| 2009/0133585 | A1 | 5/2009 | Rhome | |

FOREIGN PATENT DOCUMENTS

| | | | |
|---|---|---|---|
| GB | 159668 | A | 3/1921 |
| GB | 2202211 | A | 9/1988 |
| GB | 2218410 | A | 11/1989 |
| JP | 00272717 | A | 10/2000 |
| WO | 9708977 | A1 | 3/1997 |

* cited by examiner

DEVICE FOR DISPENSING GRANULAR FOOD PRODUCTS AND AN INSERT TO BE INSERTED IN A DEVICE FOR DISPENSING GRANULAR FOOD PRODUCTS

CROSS-REFERENCE TO RELATED APPLICATIONS

This application is a national stage entry under 35 U.S.C. 371 of International Application No. PCT/SE2010/051104, filed Oct. 13, 2010, designating the United States. This application claims foreign priority under 35 U.S.C. 119 and 365 to Swedish Patent Application Nos. 0950757-5, filed Oct. 13, 2009, and 1050482-7, filed May 17, 2010. The complete contents of these applications are incorporated herein by reference.

FIELD OF THE INVENTION

The present invention relates to a device for dispensing granular food products, for example sweets, from a container in which the granular food products are stored. The invention also relates to an insert that is filled with granular food products, the insert being intended for insertion into a device for dispensing granular food products.

BACKGROUND OF THE INVENTION

In many shops or stores where food products are sold, customers may themselves pick food products from containers or boxes and possibly also place the food products in wrappings/packages themselves. Such wrappings or packages may be, for example, bags that are provided by the store or that the customers themselves have brought. Especially in connection with sales of sweets/candies, it is frequently so that the goods are sold in bulk in such in such a way that the customers themselves may pick the quantity they wish to purchase and put it in a bag. The store usually provides scoops, spoons or other tools by means of which the customer can take the sweets/candies from their box to put them in a bag. The sweets/candies will then lie exposed in the box such that it is available to the customers. Such an exposure of sweets may be unsuitable for hygienic reasons. For example, some customers may choose to take the sweets with their hands instead of using a scoop or spoon. Some customers may even put back sweets that they have touched with their hands. Moreover, customers that suffer from infections of the respiratory passages may breathe or cough on the sweets as they bend over the boxes/containers where the sweets or candies are placed. It should be understood that this problem is not restricted to sweets and candies but may also concern other food products that are sold in bulk, for example beans, lentils or nuts.

To solve this problem, solutions have been proposed in which bulk candy is placed in a container and where dispensing of the candies is achieved by means of a screw or some other mechanism and the bulk candy is protected from direct exposure until it has been fed out from the container.

In some cases, it may also be a problem that separate pieces of granular foodstuff stick together to form large lumps. This may in particular be a problem in the case of bulk candy.

WO 97/08977 discloses a dispenser for sweets that comprises a container from which sweets can be fed out by means of a feed screw that can be caused to rotate. Rotation of the screw forces sweets in the lower part of the container through a channel and out to a receiver part.

GB 2218410 A discloses a dispensing device for a foodstuff that comprises a container with a V-shaped bottom. In the lower part of the container, there is an auger that can be rotated by means of a motor. When the auger turns, the foodstuff is fed along the bottom of the container towards a nozzle.

U.S. Pat. No. 4,311,257 discloses a device for dispensing food stuffs from a container. The device comprises a cylindrical container and a rake with a handle. By means of the handle, the rake can be moved along a longitudinal axis of the container such that food stuffs within the container are caused to move towards a dispensing opening.

US 2007/0080175 A1 discloses a system in which candy inside a container can be caused to move towards an exit area by means of a rake that can be operated from the exterior of the container.

In the above mentioned solutions, it may happen that a granular food product (for example a candy) is damaged during dispensing such that the consumer gets a damaged product. When certain kinds of granular food stuffs are broken/smashed, this can also lead to remnants of the pieces getting stuck on the walls of the container which may cause hygienic problems. This may be the case when the granular food stuff is constituted by, for example, pieces of chocolate.

Therefore, it is an object of the present invention to provide a device which not only protects the foodstuff from exposure and allows dispensing, but which also reduces the risk that the granular foodstuff is damaged during dispensing.

Another object is to provide a device that may reduce the risk that separate pieces of granular foodstuff stick together to form lumps.

It is also an object of the present invention to make it possible to refill such dispensing devices in a way that is quick and rational.

DISCLOSURE OF THE INVENTION

The invention relates to a device for dispensing granular foodstuff such as, for example, sweets/candies. The inventive device comprises a container that, at one end of the container, has a dispensing opening through which granular foodstuff may leave the container. The container further has an inside (interior) that is provided with at least one guide for the granular foodstuff. The at least one guide is fixed in relation to the container and is arranged to be able to guide granular foodstuff as the granular foodstuff moves in a direction towards the dispensing opening. According to the invention, the container is arranged so as to be rotatable about a longitudinal axis of the container, the longitudinal axis being inclined relative to the horizontal plane by an angle in the range of 3°-80°. Preferably, the longitudinal axis is inclined relative to the horizontal plane by an angle in the range of 5°-60° and even more preferred an angle in the range of 10°-25°. The at least one guide is arranged in the container such that granular foodstuff is guided towards the dispensing opening when the container rotates but remains at rest when the container is at a standstill. When the container rotates, the guide will thus rotate together with the container. Through the rotation of the container about its longitudinal axis, the guide or guides will cooperate with gravity to cause granular foodstuff to move towards the dispensing opening in a direction parallel to the longitudinal axis of the container. This will be explained in greater detail in the detailed description.

Since feeding is based on rotation of the entire container instead of an auger/feeder screw that rotates in relation to the container, relative movements between the container and the feeder screw can be avoided. Since such relative movement is avoided, the risk that the granular foodstuff will be damaged is reduced. The inventors have found that relative movement between feeder screw and container is a significant cause of mechanical damage to granular foodstuff in connection with dispensing. It is to be understood that also in the case when one uses a rake that is operated from the exterior of the container, as disclosed in e.g. US 2007/0080175 A1, there will be a relative movement between the rake and the container which can cause damage to the granular foodstuff.

The invention also relates to an insert which is designed such that it can be inserted in a dispensing device for granular foodstuff. The insert comprises an elongate container which is at least partially filled with granular foodstuff and extends from a first end to a second end along a longitudinal axis. On its inside, the container of the insert has an inner wall that is provided with elevations that form guides. A plate or disc is mounted at a distance from the second end of the container in engagement with at least some of said guides/elevations but in such a way that granular foodstuff can pass the plate or disc in an area between the plate/disk and the inner wall surface (inner face) of the container.

SHORT DESCRIPTION OF THE DRAWINGS

Figure 5:
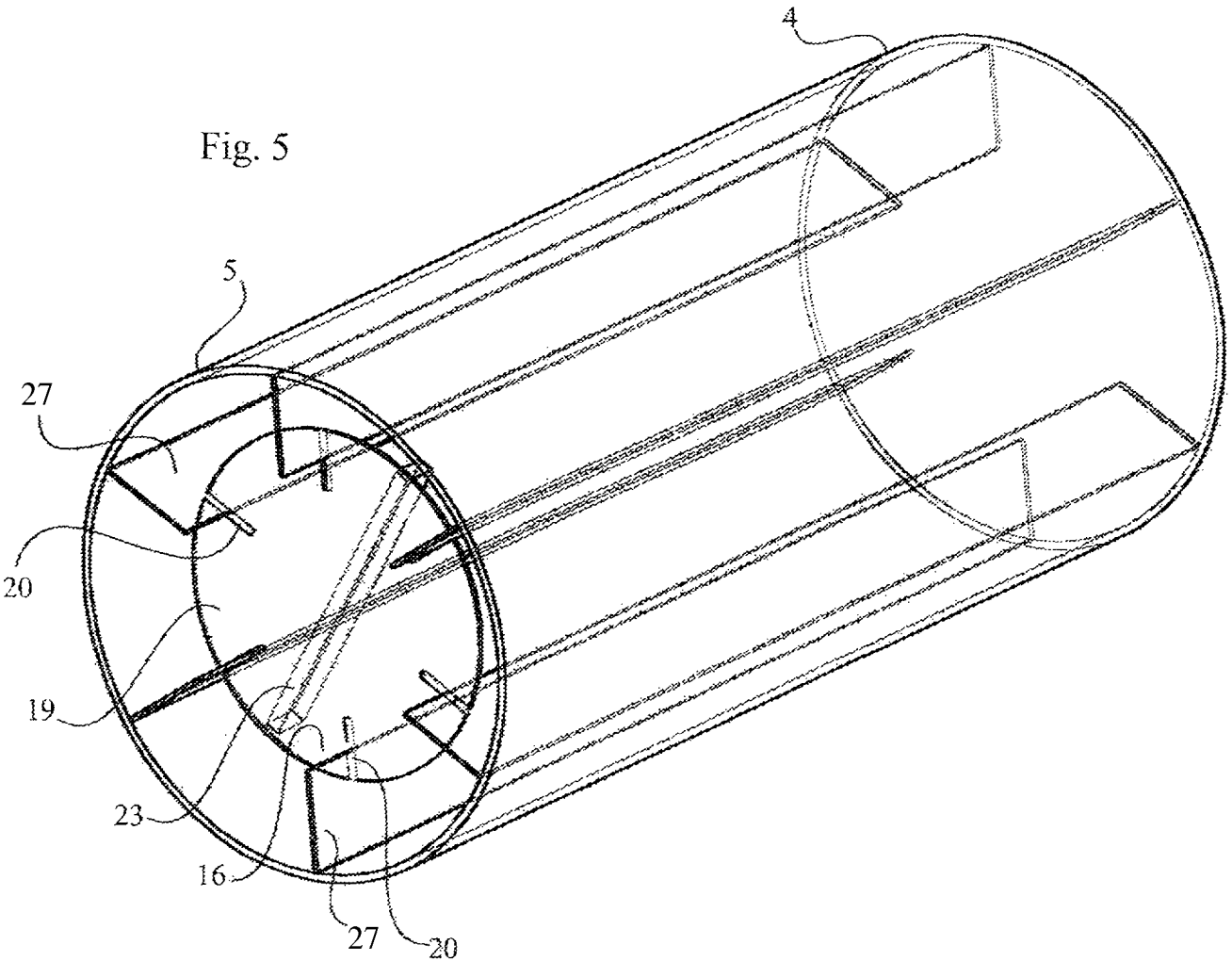
FIG. 5 shows a container that, in principle, may be identical to the container shown in FIG. 4 but where some details shown in FIG. 4 have been removed and where, instead, some details are shown that cannot be seen in FIG. 4.
Figure 9B:
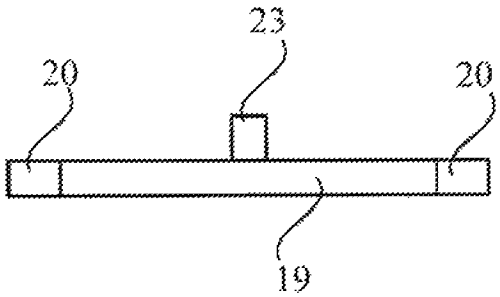
Figure 9A:
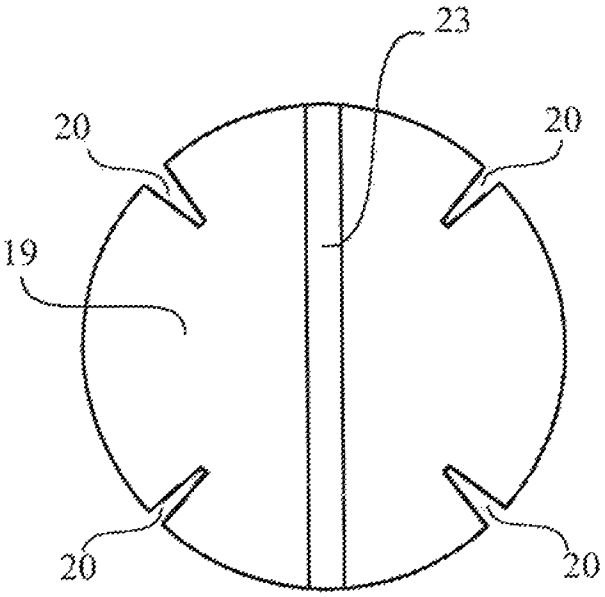

FIG. 9*a* shows, in a view from one end of the container, a detail from FIG. 5.

FIG. 9*b* shows a side view of the same detail as in FIG. 9*a*.

Figure 10:
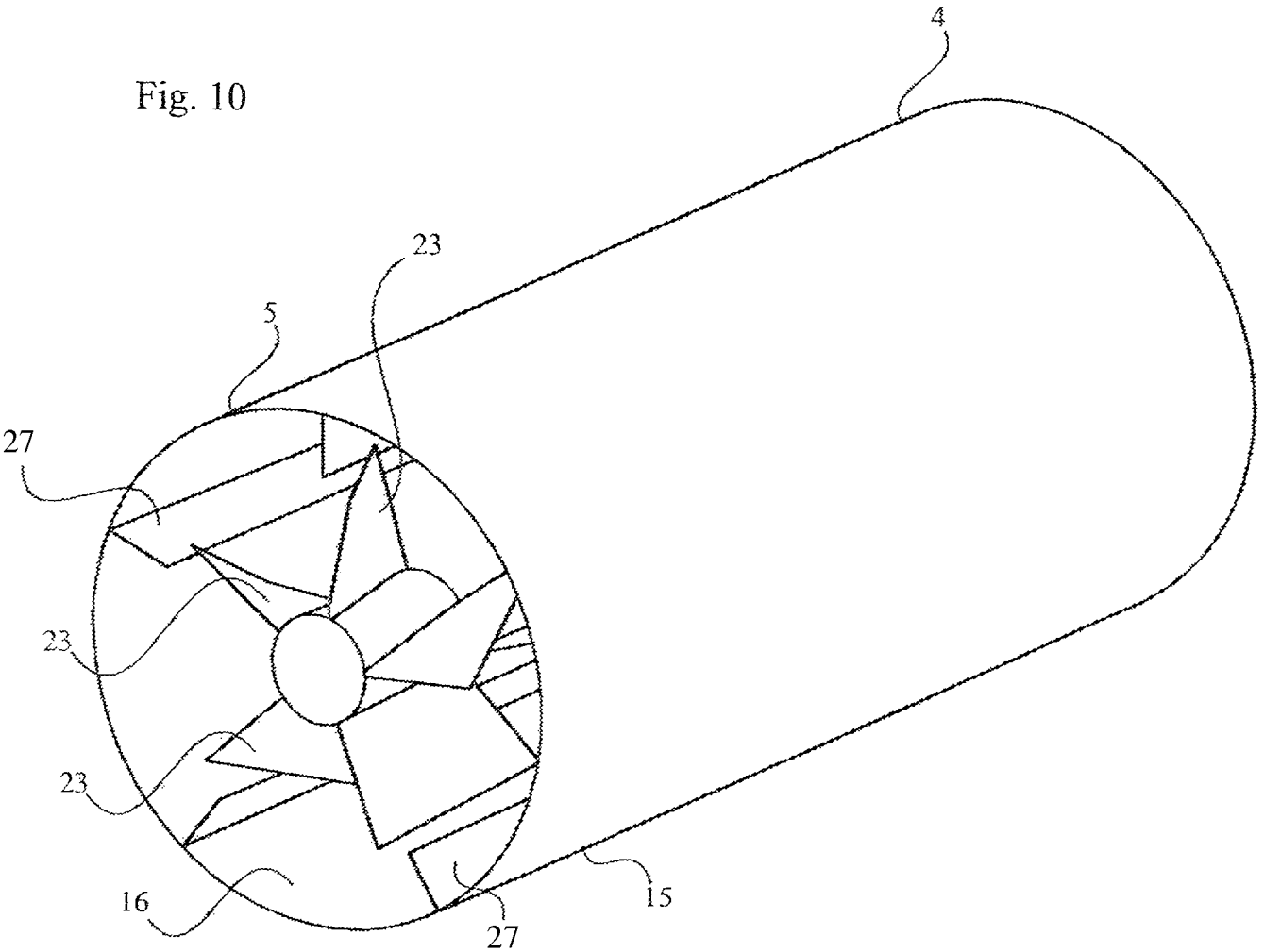

FIG. 10 shows, in perspective, a container that is a variation of the container shown in FIG. 5.

Figure 11:
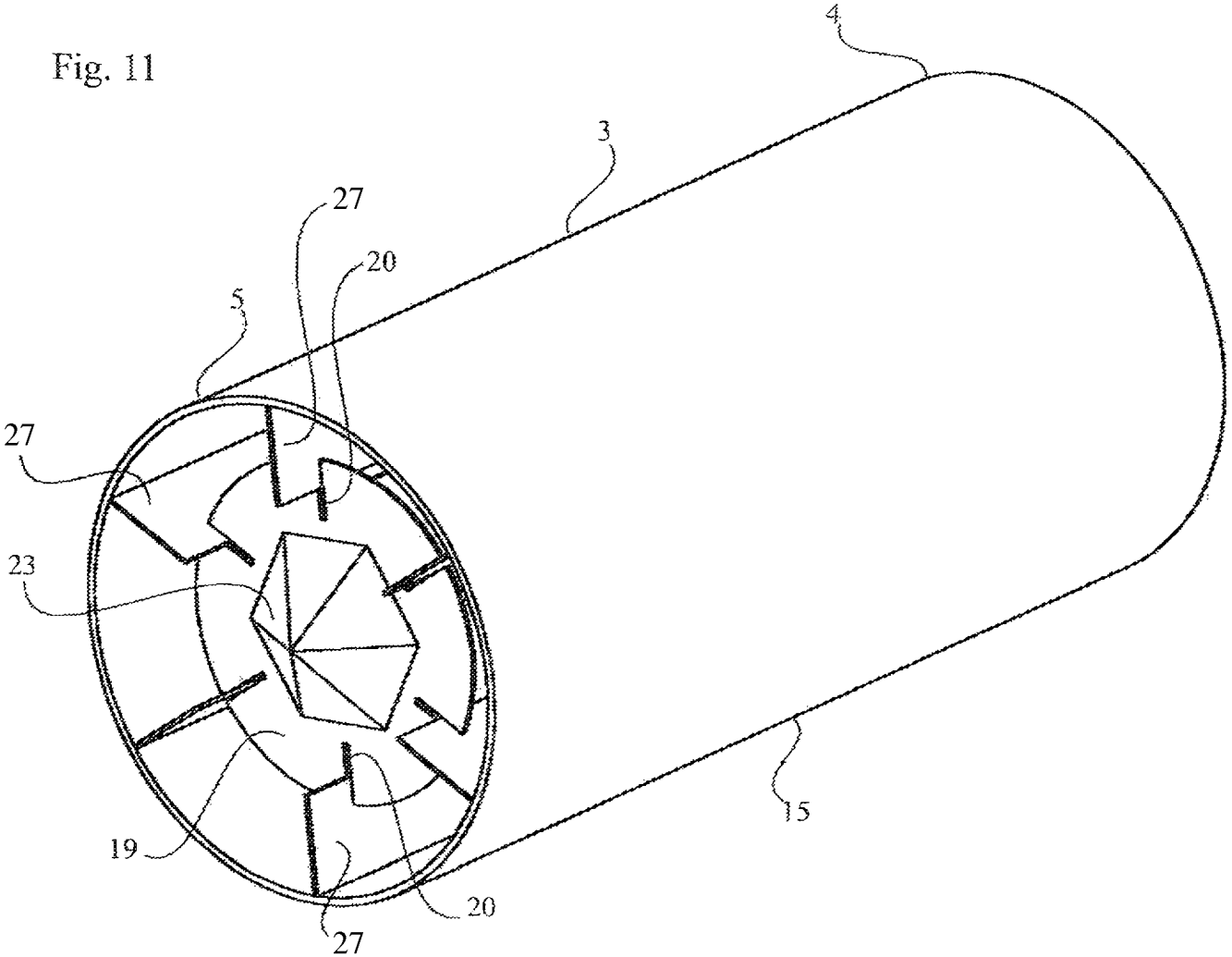

FIG. 11 shows yet another alternative embodiment for a container intended to be used in the inventive dispensing device.

Figure 12:
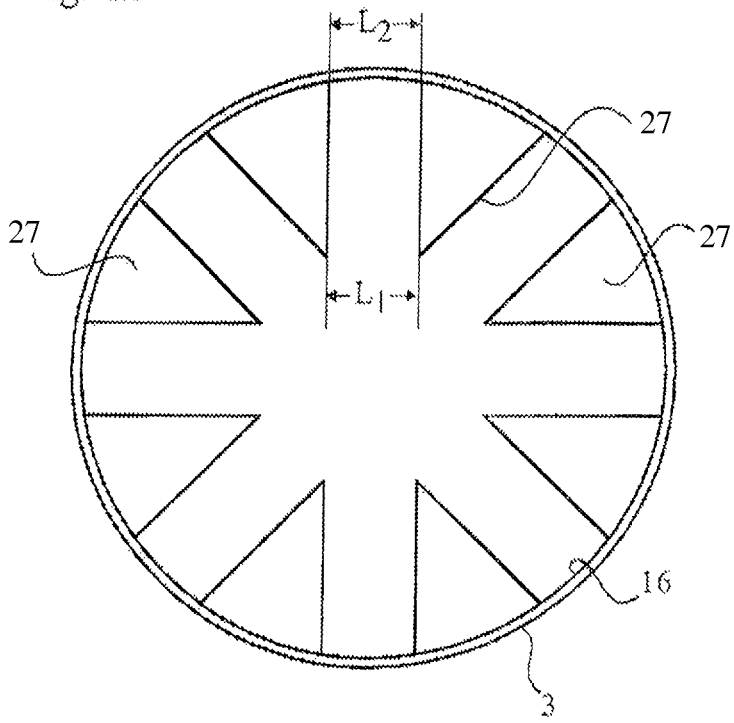

FIG. 12 shows, in cross-section, perpendicular to the longitudinal axis of the container, an advantageous embodiment of the invention.

Figure 13:
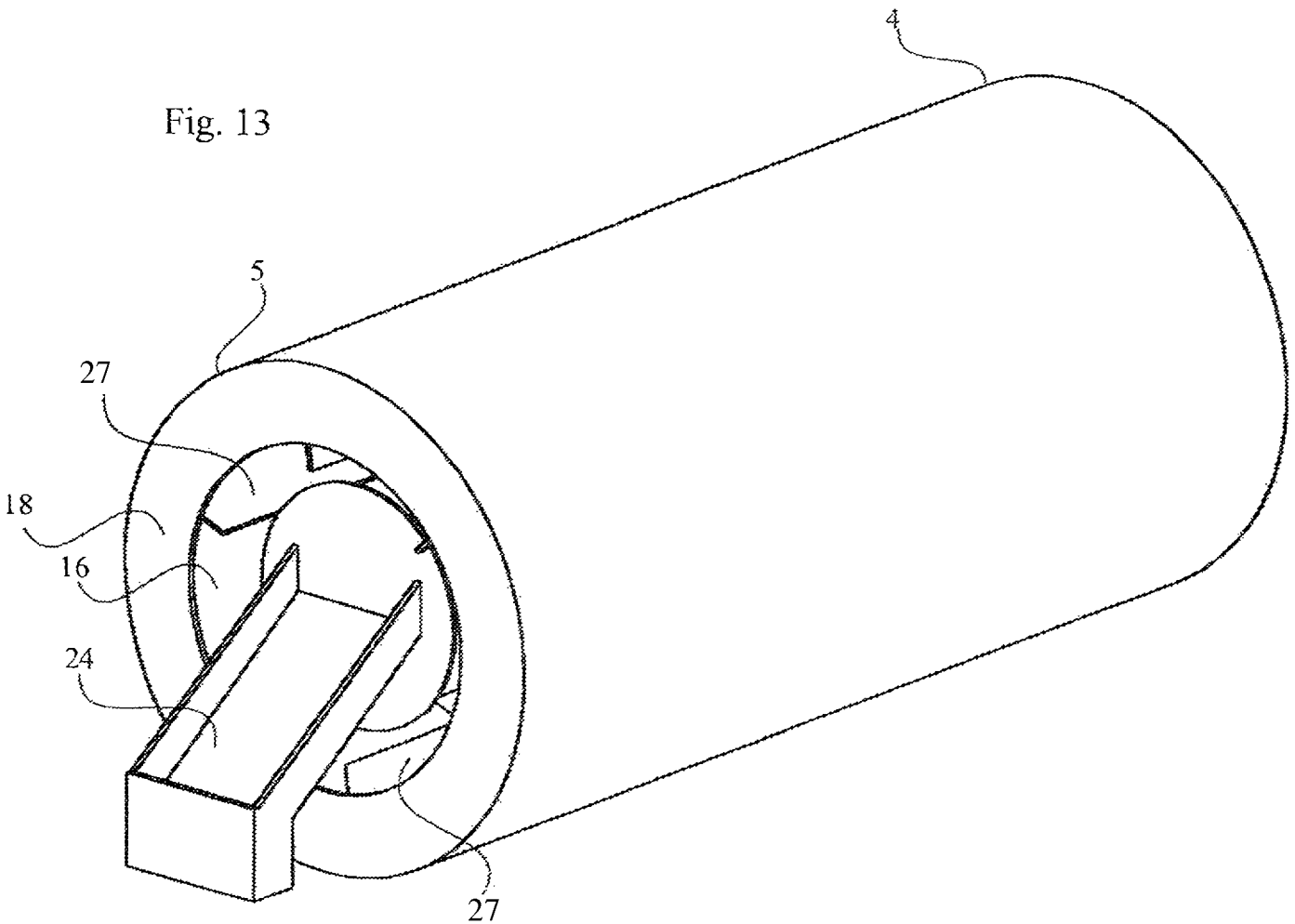

FIG. 13 shows, in perspective, an embodiment where the container has been combined with a recipient for granular foodstuff.

Figure 14:
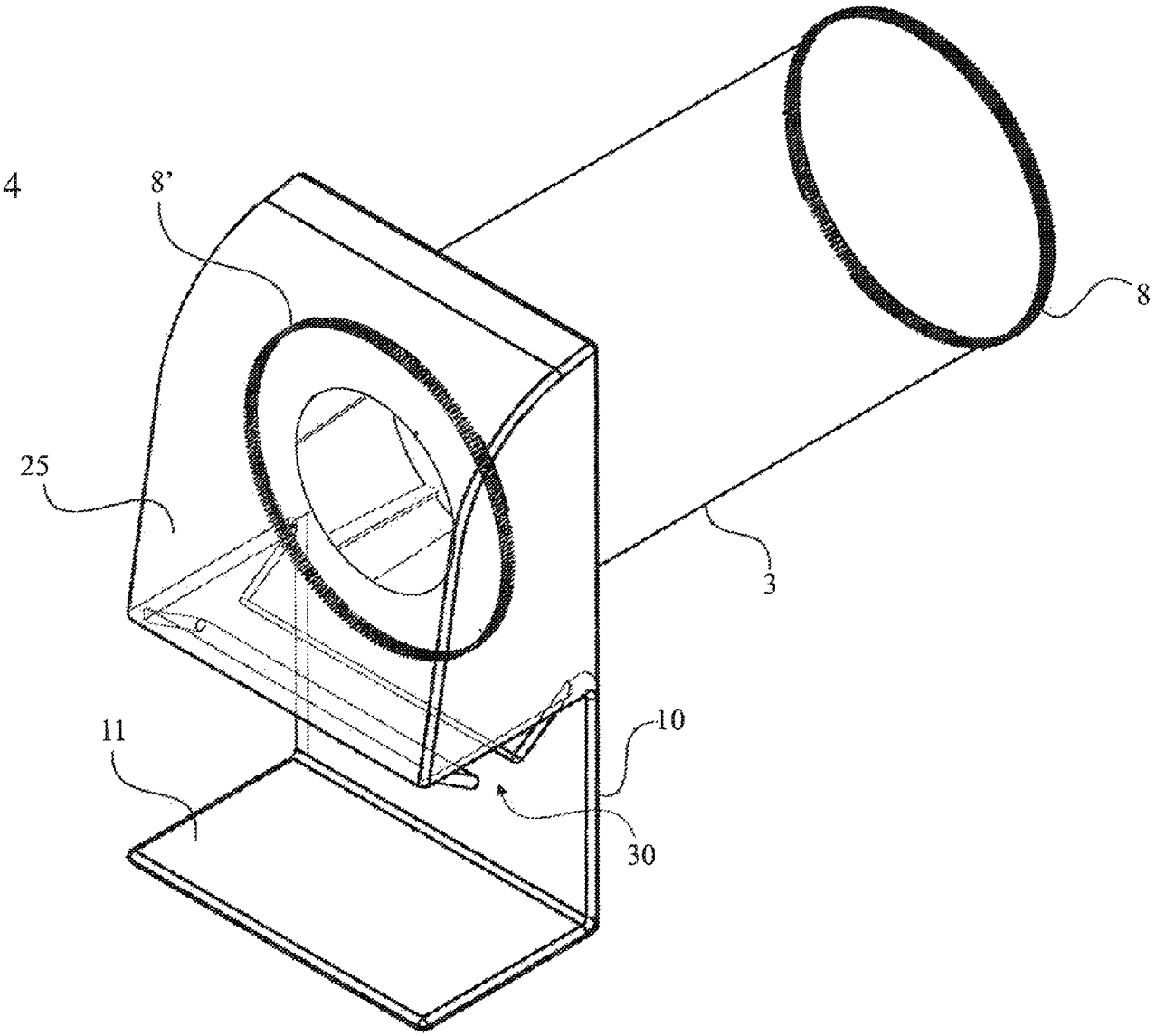

FIG. 14 shows, in perspective, another possible embodiment.

Figure 15:
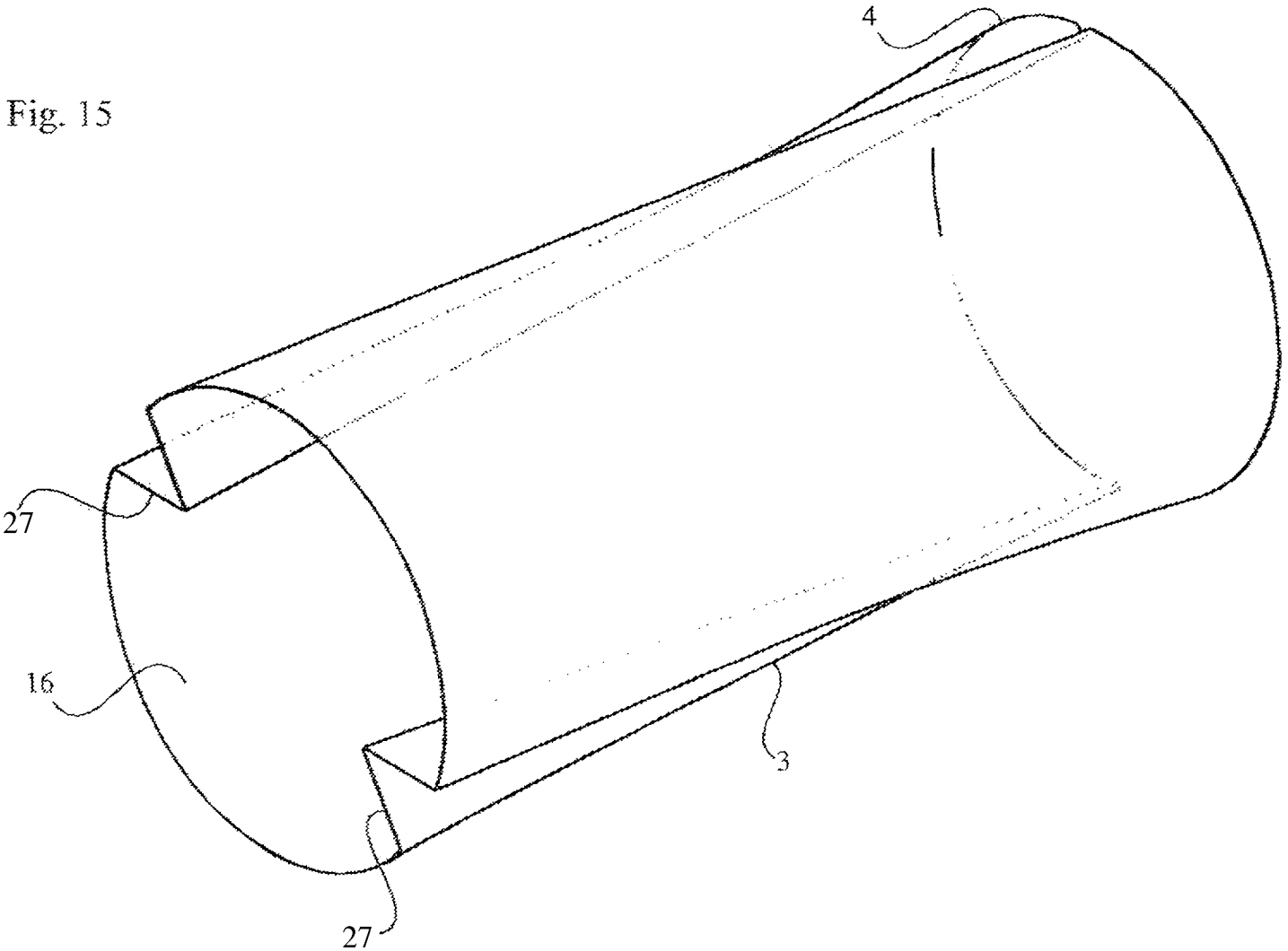

FIG. 15 shows, in perspective, another embodiment of a container for the inventive dispensing device.

Figure 16:
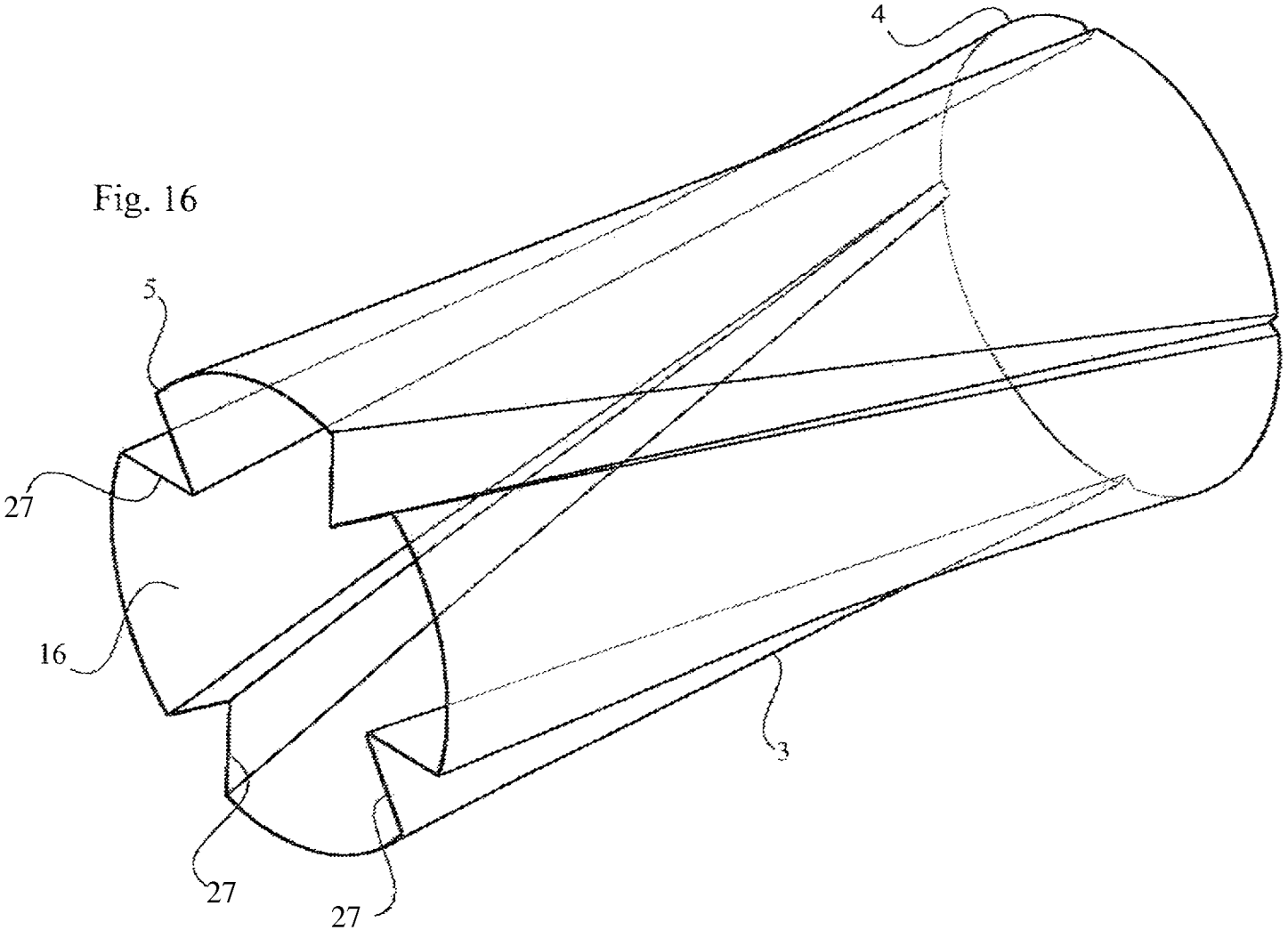

FIG. 16 shows, in perspective, yet another embodiment of a container for the inventive dispensing device.

Figure 17:
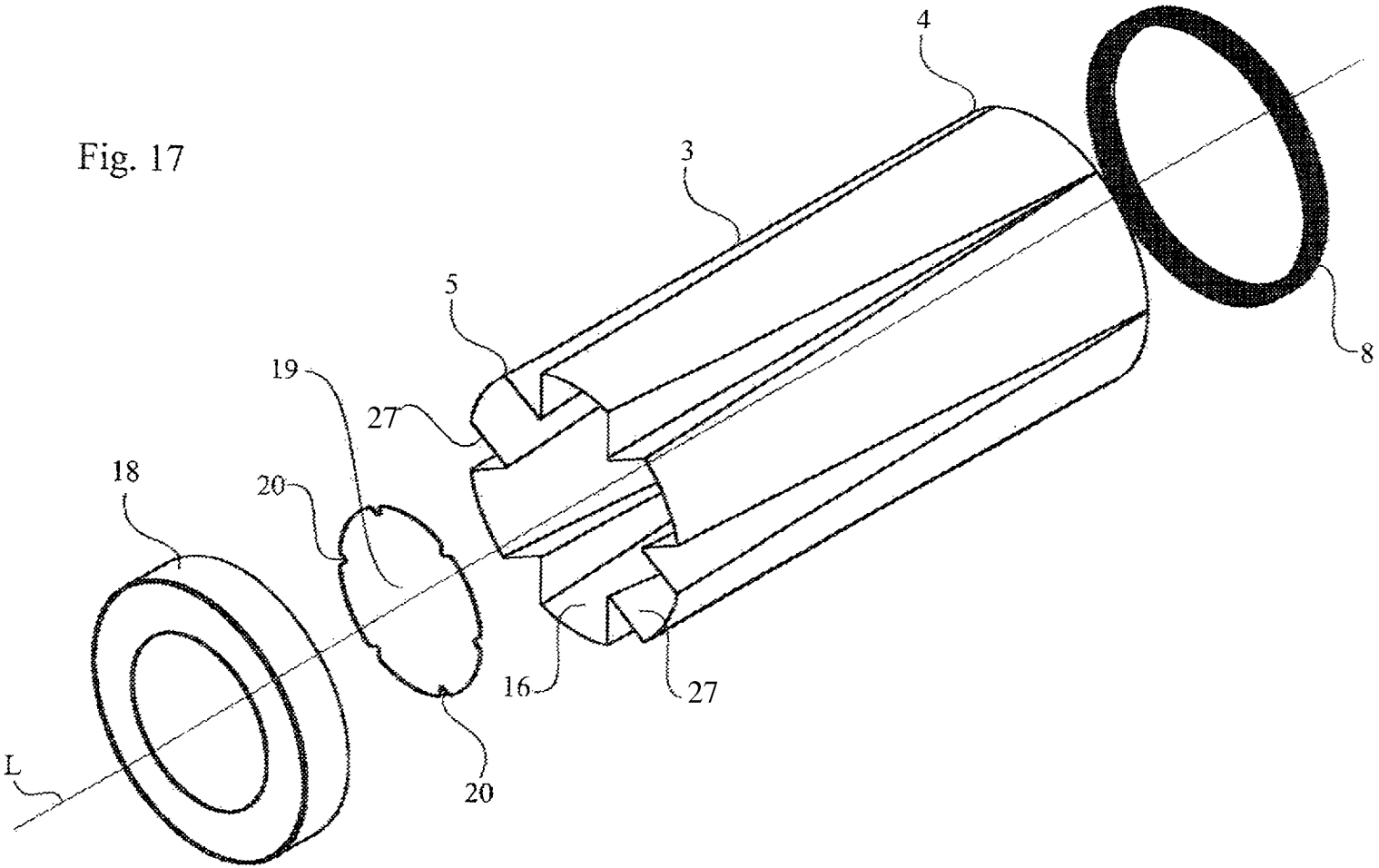

FIG. 17 is an exploded view of a possible embodiment.

Figure 18:
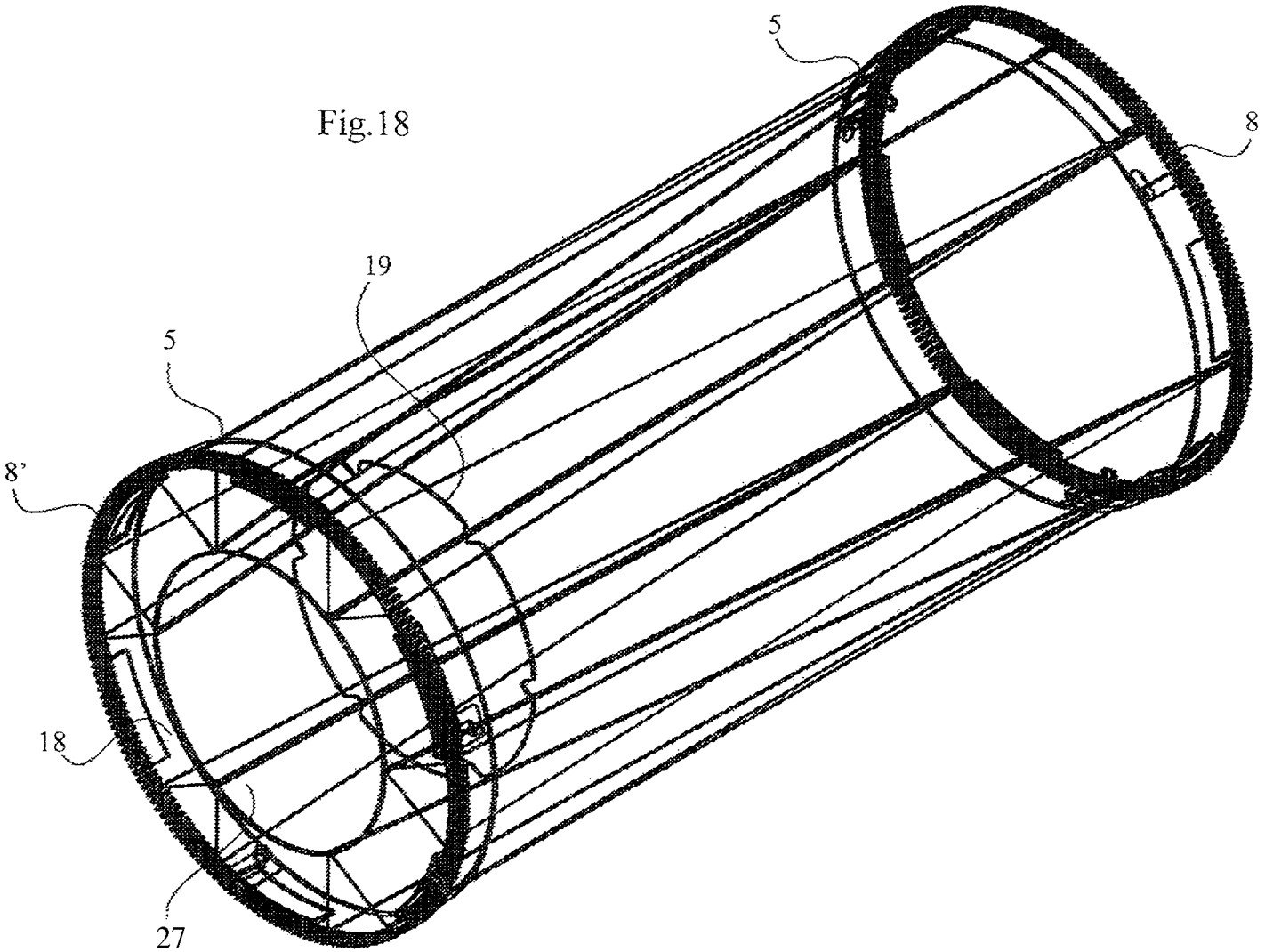

FIG. 18 shows, in perspective, how the separate parts of FIG. 17 have been assembled to a unit.

Figure 19:
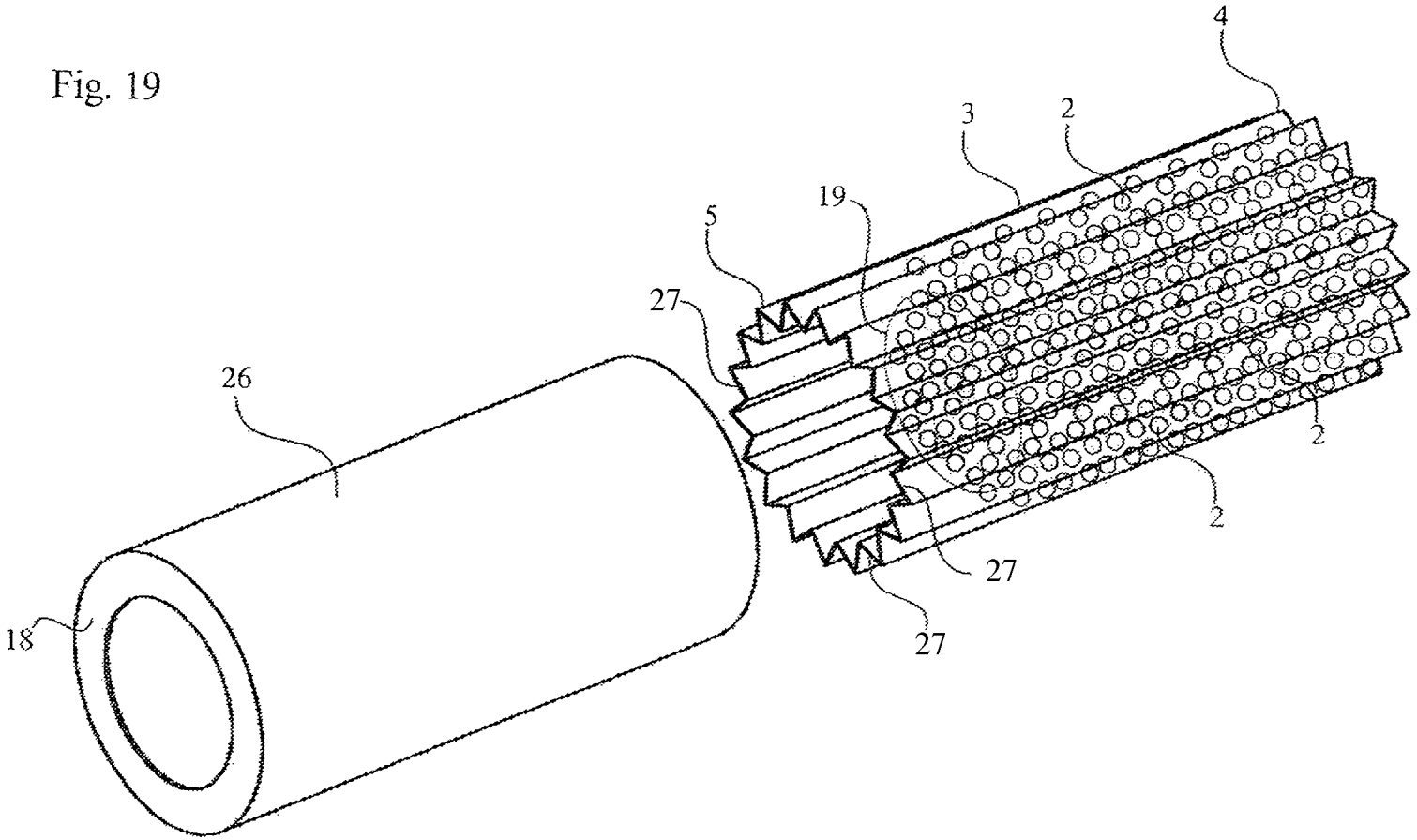

FIG. 19 is an exploded view corresponding to FIG. 17 but showing another embodiment.

Figure 20:
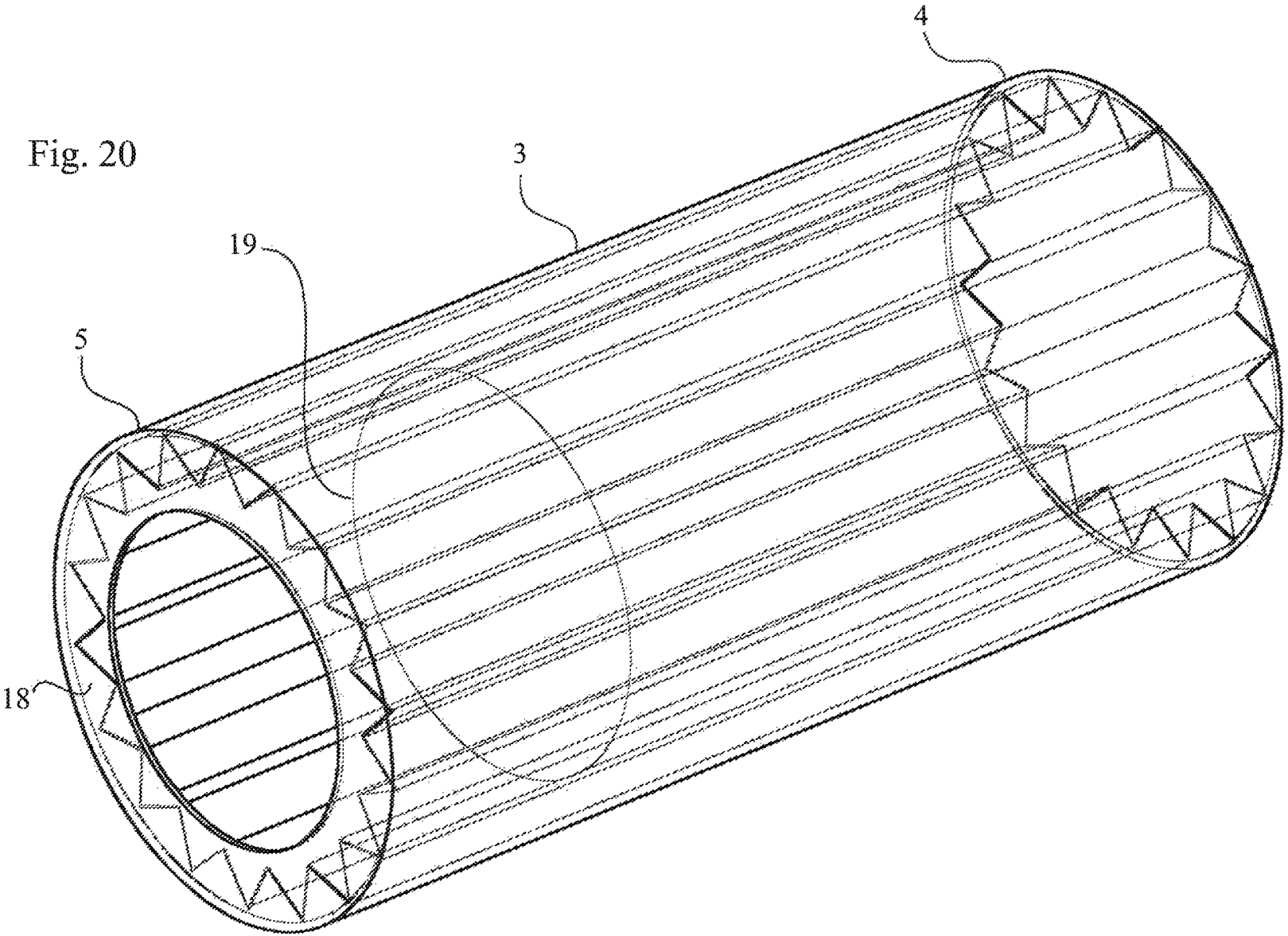

FIG. 20 shows how the components of FIG. 19 have been assembled into a unit. In FIG. 19, it can also be seen how an insert can be used to replenish an empty dispenser.

Figure 21:
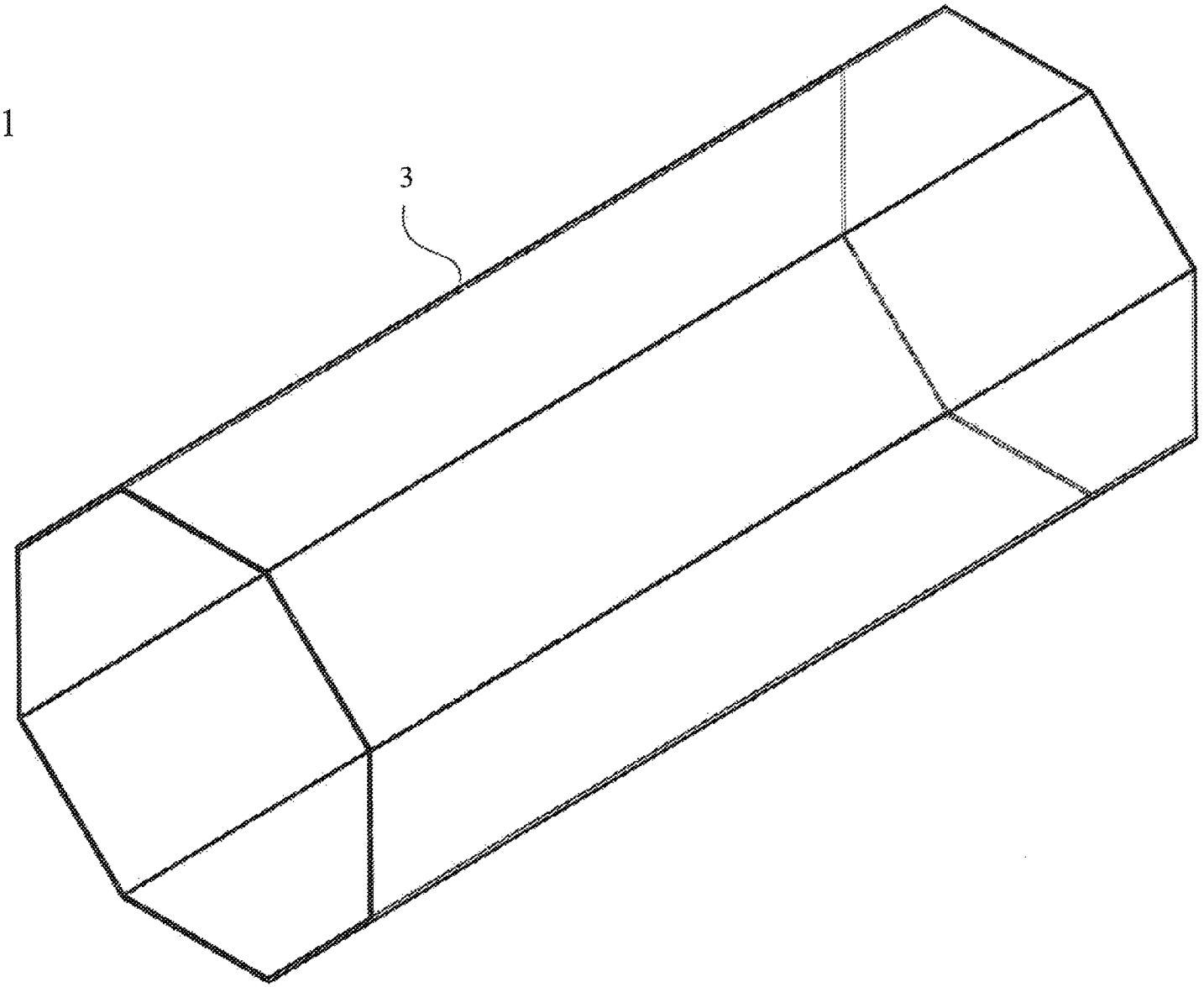

FIG. 21 shows another possible embodiment of a container intended for use with the inventive dispensing device.

Figure 22:
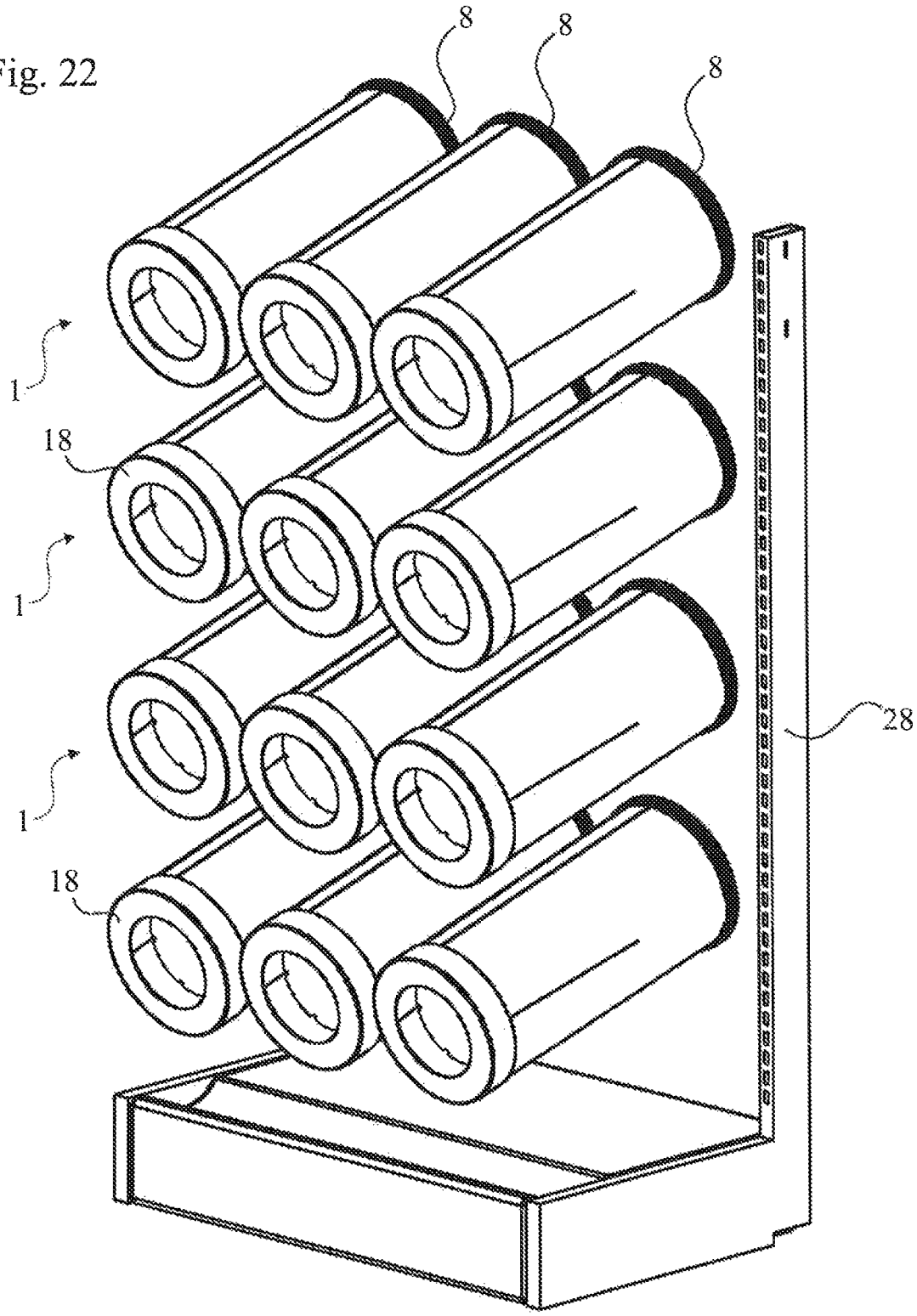

FIG. 22 shows, in perspective, how several dispensing devices have been brought together on a common carrier.

Figure 23:
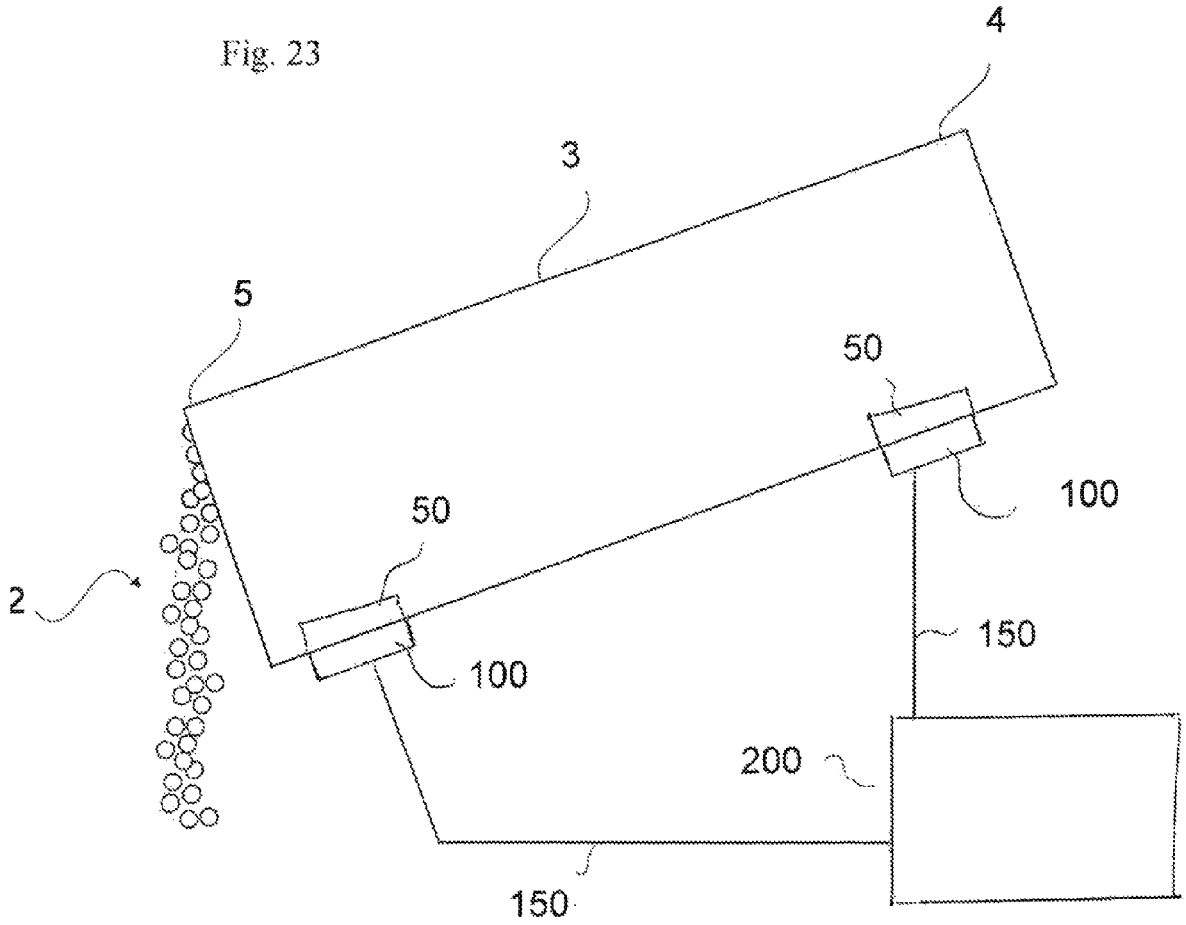

FIG. 23 is a schematic representation of an advantageous embodiment of the invention.

Figure 24:
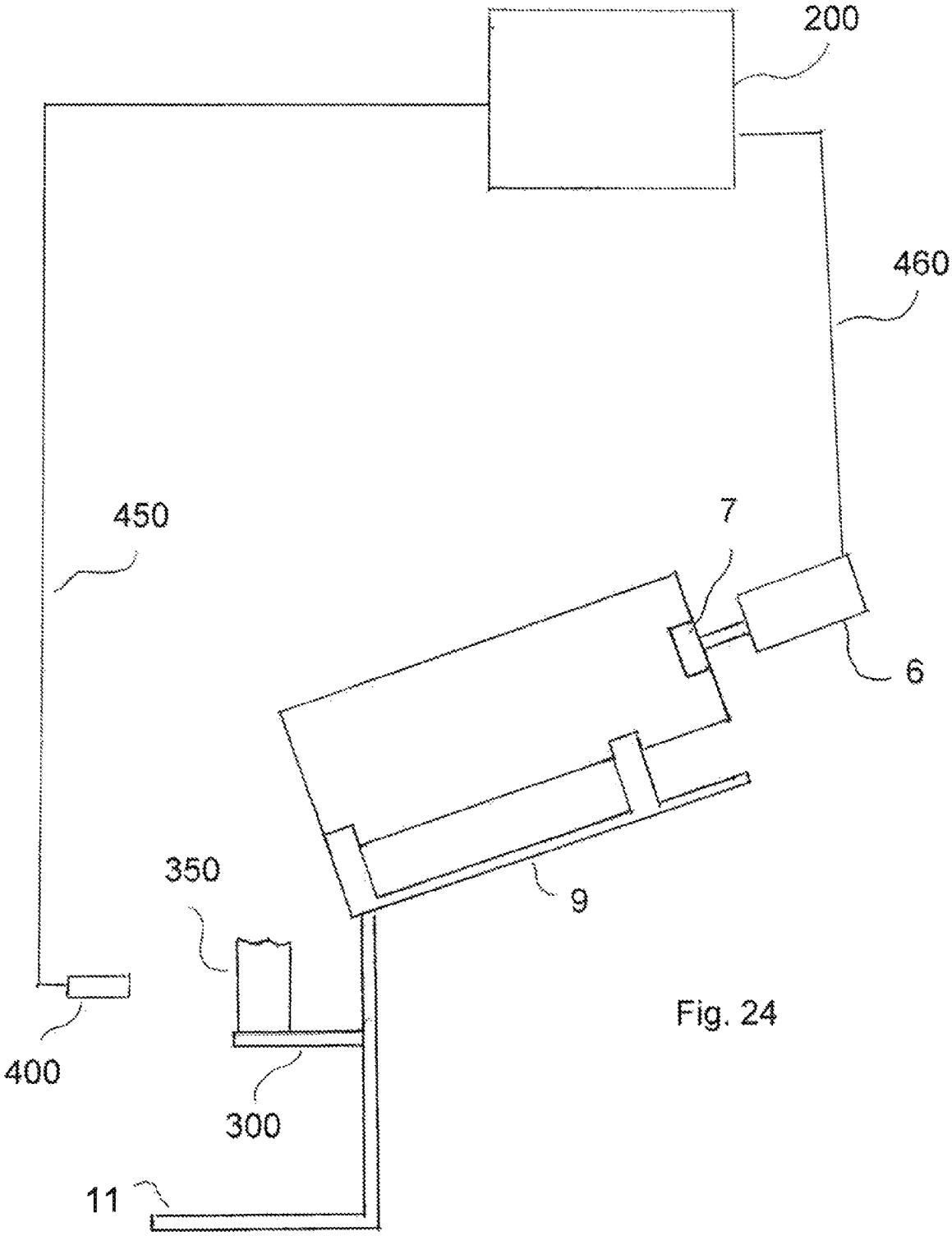

FIG. 24 is a schematic representation of yet another embodiment.

DETAILED DESCRIPTION OF THE INVENTION

For the sake of simplicity, the following text will frequently refer to sweets, candies or bulk candy. It should then be understood that what applies to sweets/candy also applies to other foodstuff.

Figure 1:
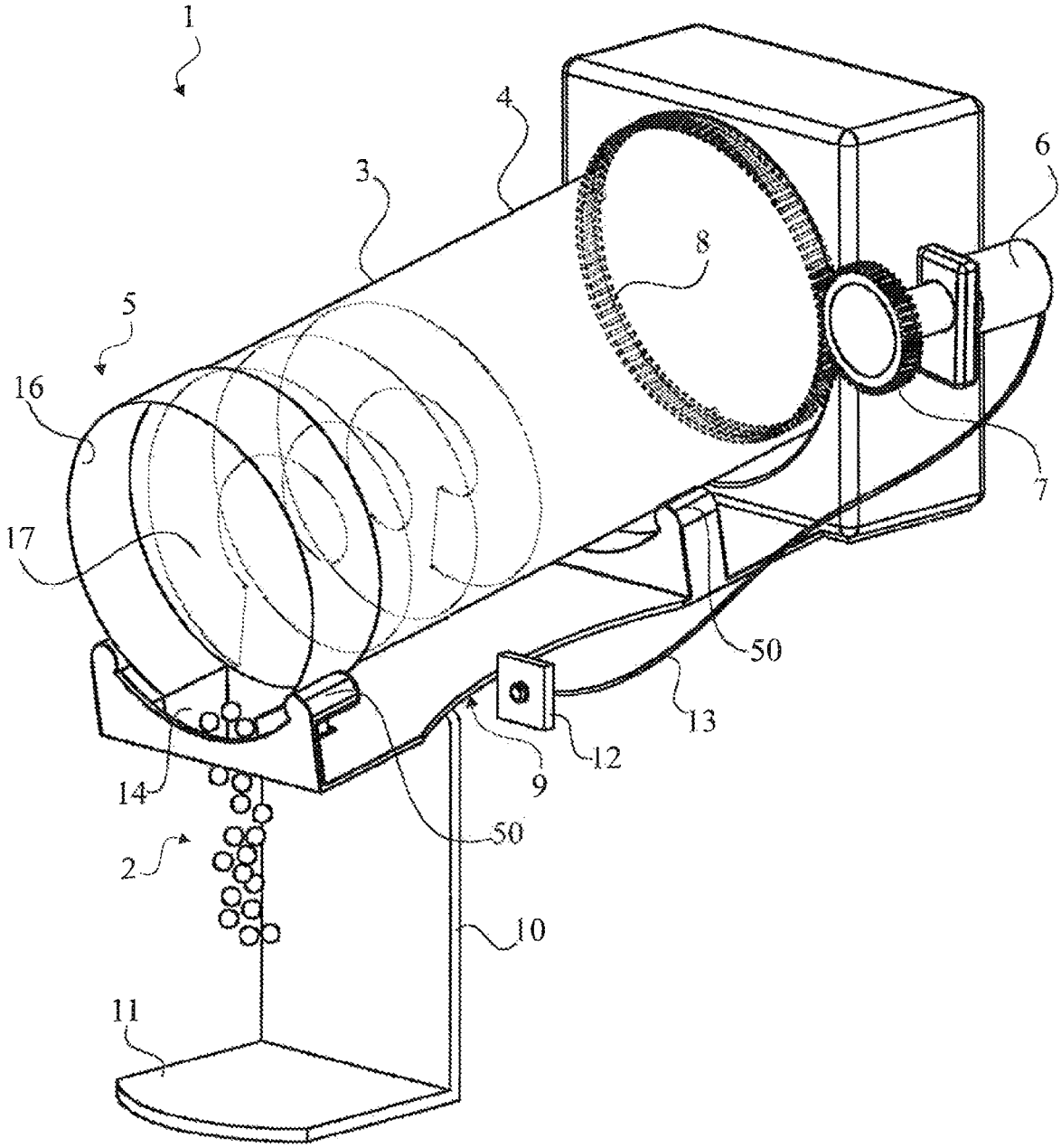
FIG. 1 shows, in perspective, an embodiment of the inventive dispensing device.

Reference will now be made to FIG. 1 where an embodiment of the present invention is shown. FIG. 1 shows a device 1 for dispensing granular foodstuff such as candies. The inventive device 1 comprises a container 3 that has a first end 4 and a second end 5. In FIG. 1, it is shown how the second end 5 is located on a slightly lower level than the first end 4 and the reasons for this will be explained in a subsequent part of this description. In the embodiment shown, the first end 4 thus constitutes an upper end while the second end 5 constitutes a lower end. The first end 4 is preferably made to be tightly closed, for example by application of a tightly closing cover or lid. At the second end 5 of the container 3, the container 3 has a dispensing opening 14 through which granular foodstuff 2 can exit the container 3.

The container 3 has an inside (interior) with an inner wall surface 16. The inside of the container 3 is provided with at least one guide 17 for the granular foodstuff. The guide is fixed in relation to the container 3 and is arranged to be able to guide granular foodstuff 2 that moves in a direction towards the dispensing opening. The container 3 is arranged to be rotatable about a longitudinal axis for the container and the longitudinal axis is inclined relative to the horizontal plane by an angle in the range of 3°-80°. Preferably, the longitudinal axis is inclined relative to the horizontal by an angle in the range of 5°-60° and even more preferred an angle in the range of 10°-25°. If the angle is small, gravity will be less able to assist in moving the granular foodstuff. When the angle becomes too large, it becomes more difficult to obtain a steady controlled flow. The proper choice of angle may depend on a number of different factors such as the nature of the granular foodstuff itself and friction between the container wall and the foodstuff. However, an angle in the range of 10°-25° will usually be adequate.

Furthermore, the at least one guide 17 is so arranged in the container 3 that granular foodstuff 2 will be guided towards the dispensing opening 14 when the container 3 rotates about its axis but remains at rest when the container 3 is at a standstill.

Figure 2:
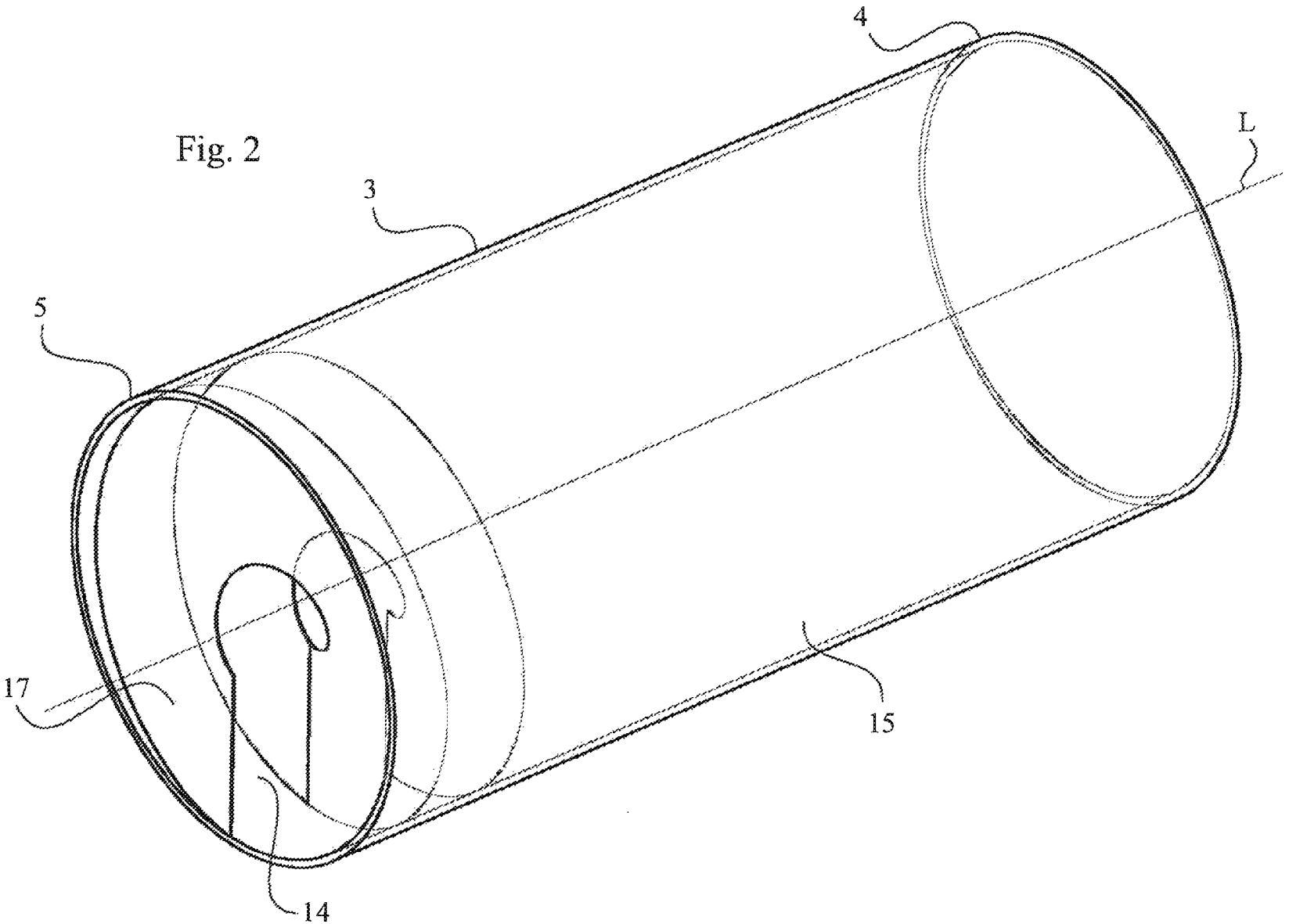
FIG. 2 shows, in perspective, a container in accordance with the embodiment shown in FIG. 1.

In the embodiment shown in FIGS. 1 and 2, said at least one guide is formed by a screw/worm 17 that fixed on the inside (interior) of the container 3. The screw is preferably fixed in relation to the container such that the screw 17 is incapable of moving relative to the inner wall surface 16 of the container 3. Preferably, the radially outermost part of the screw extends all the way to the inner wall surface 16 of the container 3 and is attached to it, possibly glued, welded or cast in one piece with the container.

As shown in FIG. 1, the container 3 is placed in a cradle or holder 9 that can hold the container 3 in such a position that the longitudinal axis L of the container 3 is inclined (the longitudinal axis L that is centrally located in the container 3 is visibly marked in FIG. 2). Thereby, the second end 5 of the container will be a lower or bottom end of the container 3. The container 3 can rotate about its longitudinal axis when it lies in the support/cradle 9. It should be understood that the inclination of the longitudinal axis L relative to the horizontal remains the same as the container 3 rotates about its longitudinal axis. The support or cradle 9 may have special support rolls that support the container 3 and allow rotation. Alternatively, the cradle 9 may have glide bearings to allow rotation of the container 3. In FIG. 1, it is shown how the cradle 9 has a leg 10 and a foot 11. It should be understood that the cradle 9 may have more than one leg 10 and more than one foot 11. For example, the cradle may have two, three or four legs 10 of which either some or all have a foot 11. In FIG. 1, it is also shown how the support/cradle 9 may have rotatable support rolls 50. The parts indicated as support rolls 50 may also be fixed (non-rotatable) parts 50 that are made in a material with low friction and that have a smooth surface such that the container 3 can rotate easily. The cradle or support 9 supports the container 3 when the inventive device 1 is used such that the inclination of the container 3 may remain constant as the container 3 is rotated about its longitudinal axis.

In FIG. 1, it is shown how, at its first end 4 (i.e. at its upper end), the container 3 is provided with an exterior gear ring 8 that extends around the exterior periphery of the container 3. A motor 6 may be arranged to drive a gear wheel 7 that engages the gear ring 8. A switch 12 may be connected to the motor via a cable 13. By pressing the switch 12, one can cause the motor 6 to start and turns the gear wheel 7 such that it, through its engagement with the gear ring 8, causes the container 3 to turn in its cradle 9. It is to be understood that embodiments are conceivable where the container 3 is rotated manually or by means of a crank. The motor 6, the gear wheel 7, the gear ring 8, the switch 12 and the cable 13 are thus not of decisive importance for the function of the invention.

When the container 3 is filled with sweets, the inventive dispensing device functions in the following way. Sweets that lie in the container 3 tend, due to the inclination of the container 3, to glide in a direction towards the dispensing opening 14. However, the guide 17, i.e. the screw, extends from the inner wall surface 16 of the container 3 and radially inwards. Thereby, the screw will prevent sweets 2 from moving in an axial direction in the container. Instead, sweets/candies will remain in the areas between the threads of the screw. Only sweets that lie at the end of the screw can fall out through the dispensing opening 14. If the container 3 is now caused to rotate, for example by the motor 6 acting on the gear ring 8 via the gear wheel 7, the screw and the container 3 will rotate together since they are fixedly connected to each other. Sweets 2 that lie between the threads of the screw will then move in a direction towards the dispensing opening 14 such that the sweets 2 fall out therethrough. The guide 17, which is fixed in relation to the container 3, is arranged such that, in interaction with gravity, it acts on the sweets to cause them to move in the axial direction of the container 3, i.e. in a direction extending essentially from the first end 4 of the container towards the second end 5 of the container 3 where the dispensing opening 14 is located. If the container is continuously replenished with sweets, the sweets will be fed from behind according to the principle "first in-first out". Thereby, the advantage is gained that no old sweets or old sugar will remain in the container. Accordingly, it can be seen in FIG. 1 how sweets 2 fall out through the dispensing opening 14. A user of the inventive device can then hold a bag under the dispensing opening and collect the dispensed sweets therein.

The switch 12 and the motor 6 may advantageously be arranged such that a push on the switch 12 causes the motor 6 to run during a predetermined period of time such that the container 3 makes a predetermined rotation, for example a certain number of revolutions, and thereby dispenses a predetermined quantity of sweets.

Figure 3:
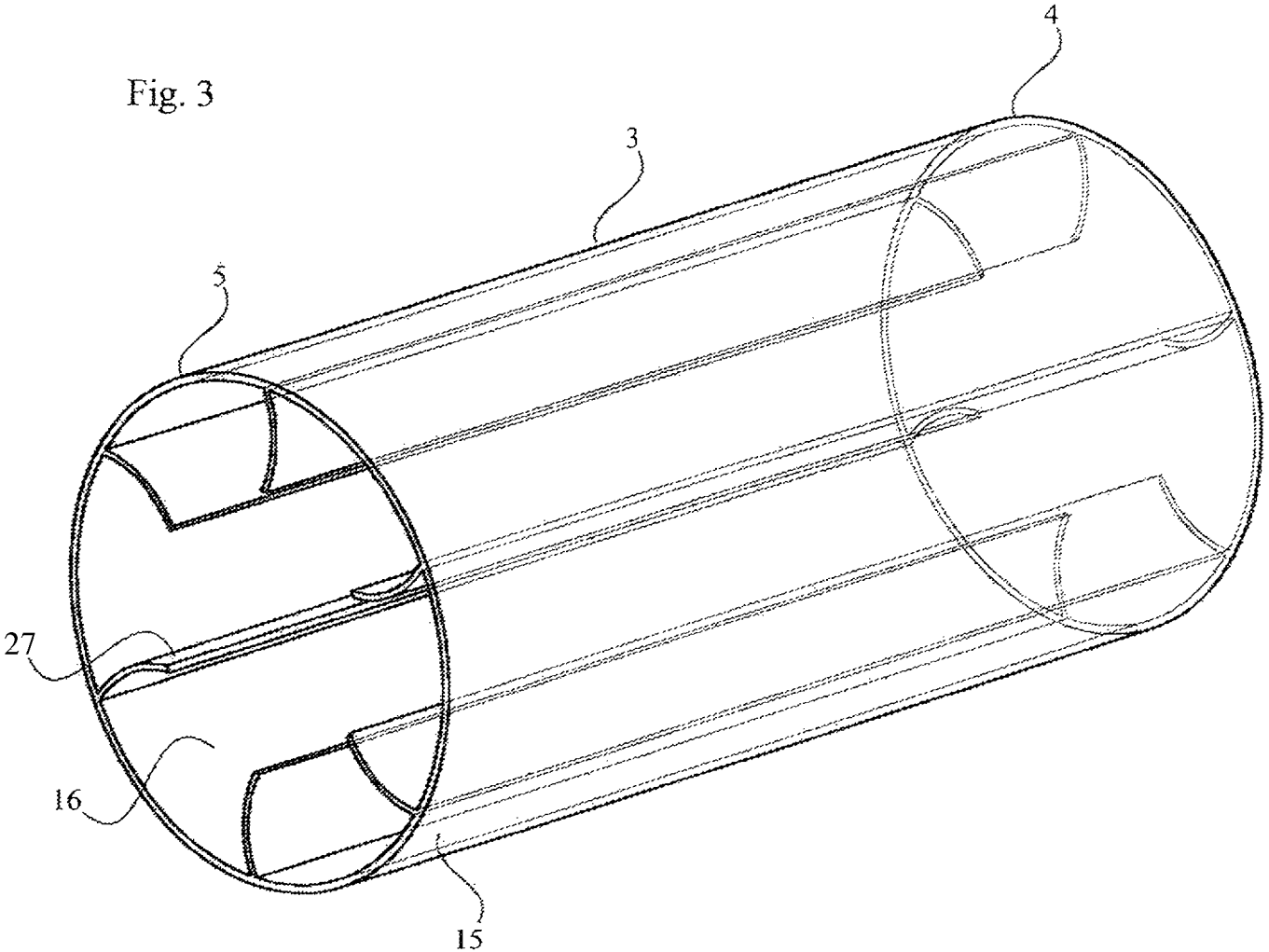
FIG. 3 shows, in perspective, a container according to another embodiment.
Figure 4:
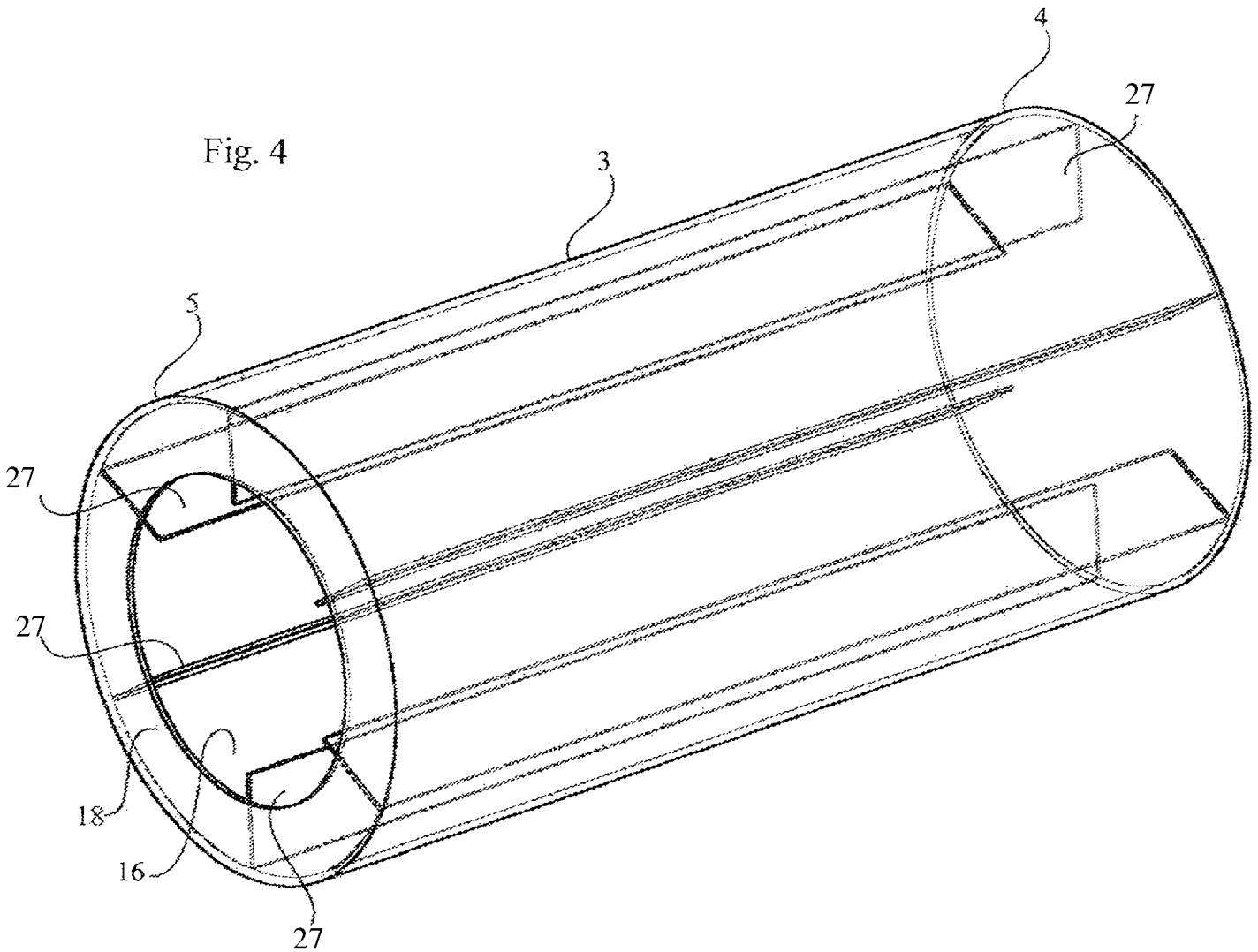
FIG. 4 shows, in perspective, a container that is a slight variation of the container shown in FIG. 3.

Another kind of guide will now be explained with reference to FIGS. 3-7. In other embodiments of the invention, said at least one guide may comprise a plurality of longitudinally extending guides 27 in the shape of longitudinal elevations on the inner wall surface 16 of the container 3. These longitudinal elevations 27 are fixed in relation to the container 3 and extend essentially in the direction of the longitudinal axis of the container 3 and divide the area around the dispensing opening 14 into at least two compartments 21 that are separated from each other. In FIG. 3, it can be seen how the guides 27 are formed by elevations that have been shaped as longitudinally extending rails that are slightly curved about an axis parallel to the longitudinal axis of the container 3. Another variation, where the longitudinal elevations 27 are formed by straight (i.e. not curved) rails, is shown in FIG. 4 and FIG. 5. The guides shown therein are formed by longitudinally extending rails that extend in the axial direction of the container 3, i.e. parallel to or essentially parallel to the longitudinal axis of the container 3. The longitudinally extending elevations 27 that form guides may also be more or less curved along the inner wall surface 16 of the container 3 such that they approach the shape of the thread of a screw. Although they extend mainly in a direction which is parallel to the longitudinal axis L of the container 3, they are thus not necessarily exactly parallel to the longitudinal axis L.

It is to be understood that FIG. 4 and FIG. 5 show the same embodiment but that, for reasons of clarity, certain parts are shown only in FIG. 4 and certain other parts are shown only in FIG. 5. In FIG. 4, it can be seen how the container 3 has a collar 18 in the area around the dispensing opening 14, the collar extending radially inwards towards the longitudinal axis of the container. This collar 18 presents an obstacle for sweets 2 that have reached the dispensing opening 14 and the collar 18 can prevent the sweets from falling out through the dispensing opening 14. As can be seen in FIG. 5, a plate/disc 19 is arranged inside the container 3 at a distance from the dispensing opening 14. The plate 19 partially blocks the path towards the dispensing opening 14. Thereby, the plate or disc 19 functions as an obstacle or brake for the granular foodstuff 2 that counteracts the tendency of granular foodstuff 2 to fall from the container due to the force of gravity. For convenience, the plate or disc 19 will be referred to as the "braking plate" in the following since it functions as an obstacle or a brake for the granular foodstuff 2. It should be understood that the collar 18 and the braking plate 19 also serve a guiding function since they contribute to defining the path that the granular foodstuff 2 must take when the container 3 is rotated as will be explained. The collar 18 and the braking plate 19 can thus be considered as being guides. Embodiments are conceivable that use a collar 18 but no braking plate 19 but the braking plate 19 significantly improves the overall function of the dispensing device.

Figure 7:
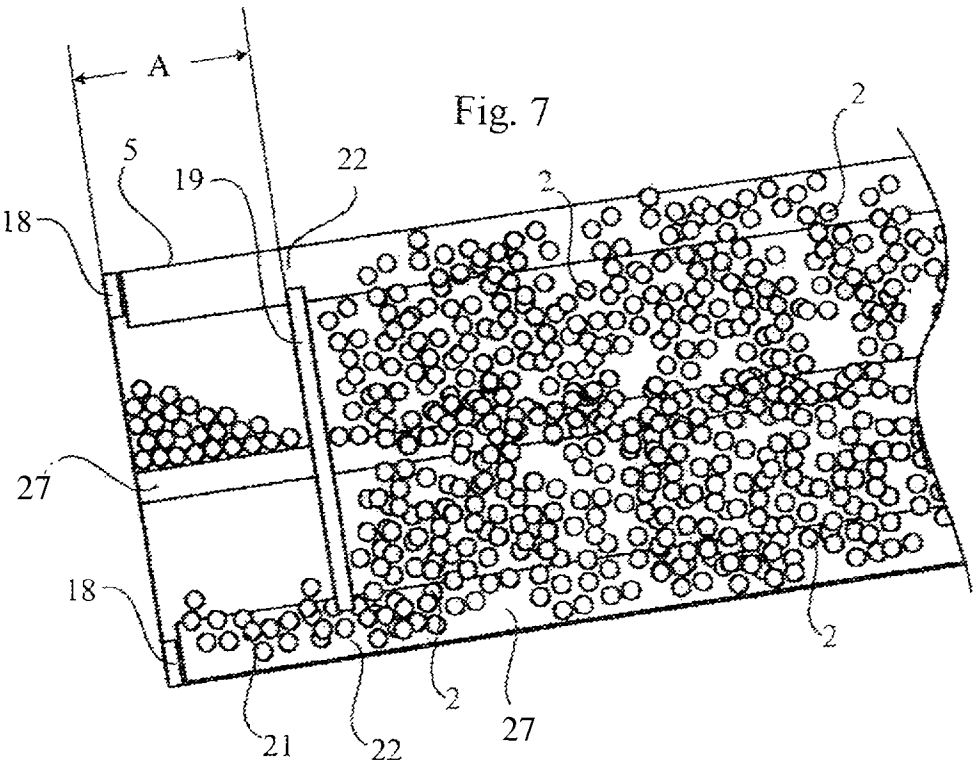
FIG. 7 shows, in cross-section, a container according to FIGS. 5 and 6 during a stage of the dispensing.
Figure 6:
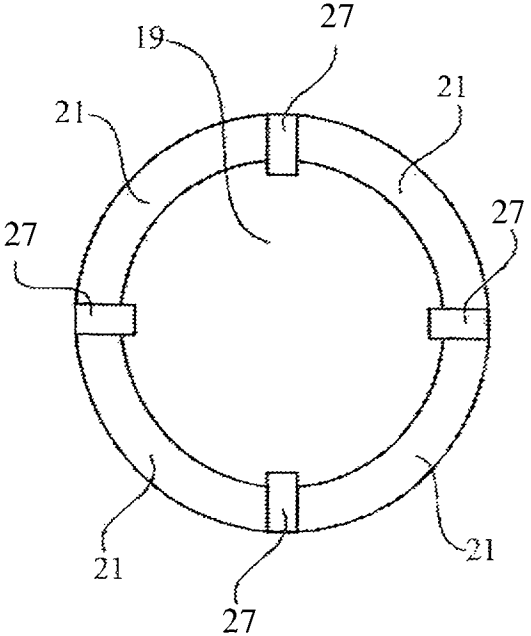
FIG. 6 shows an end view of a container according to FIG. 5.
Figure 8:
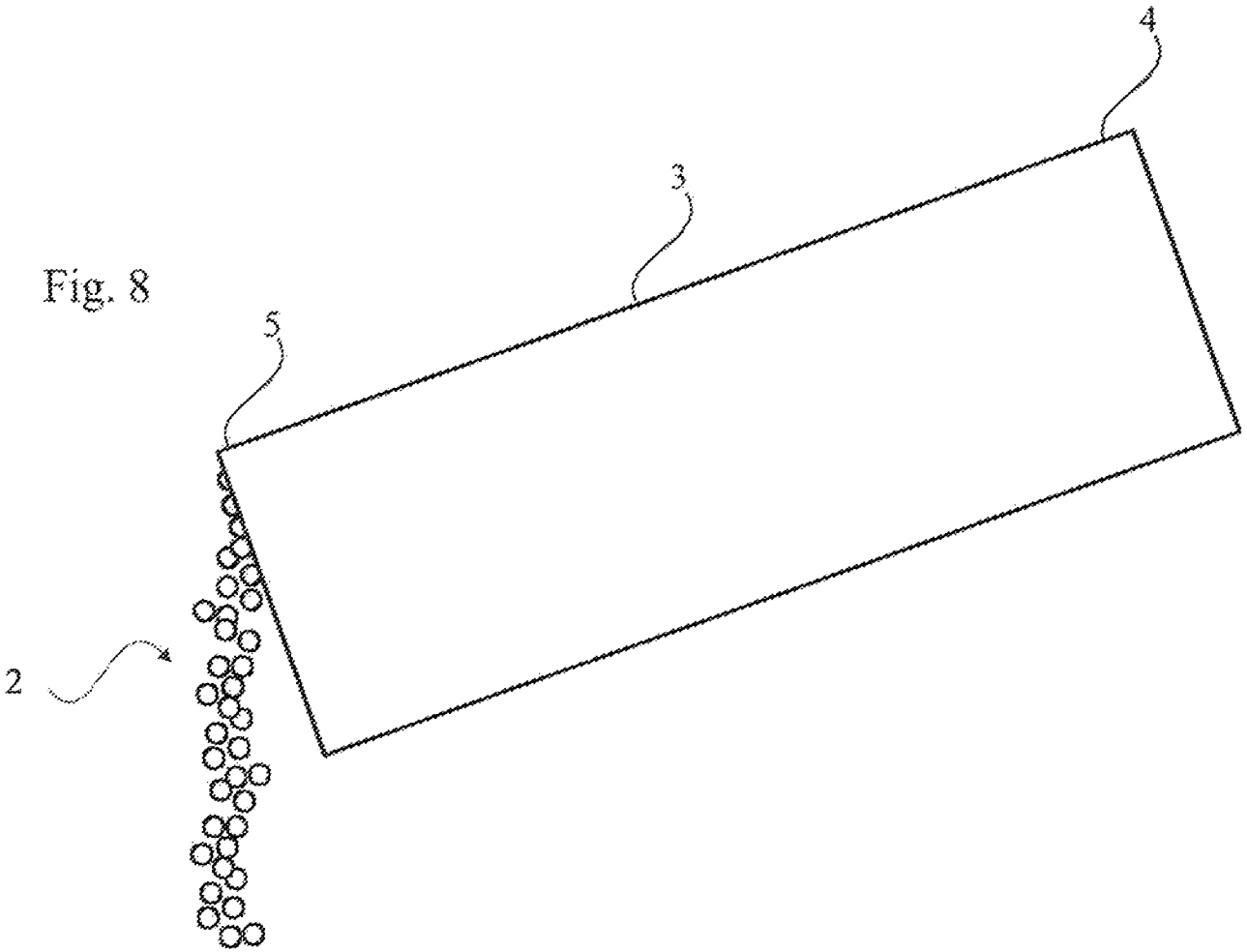
FIG. 8 shows a side view of the container of FIG. 7 but at a later stage of the dispensing.

It is to be understood that the longitudinal elevations/rails 27 which, in this embodiment, constitute guides on the inner surface 16 of the container 3, form separate compartments 21 for the granular foodstuff in the area between the collar 18 and the braking plate 19. This can also be seen in FIG. 6 and FIG. 7. As shown in FIG. 7, a part of the sweets 2 has been able to glide along the inner wall surface 16 of the container 3 and pass between the braking plate 19 and the inner wall surface 16 of the container 3. These sweets have then reached a compartment 21 that is delimited in the axial direction by the collar 18 and in the circumferential direction is delimited on its sides by two different longitudinal elevations/rails 27 as can be seen in FIG. 6 and FIG. 7. In FIG. 7, it can also be seen how sweets that have previously lain in a lower compartment 21 has attained a somewhat higher position due to rotation of the container 3. If the container 3 is not rotated about its longitudinal axis any more, the sweets that lie closest to the dispensing opening 14 will remain in their respective compartments 21 and sweets further upwards in the container 3 will be prevented by the braking plate 19 from moving towards the dispensing opening 21. If the container 3 is not rotated about its longitudinal axis, a compartment 21 that contains sweets 2 will reach the uppermost position. In this position, the collar 18 can no longer prevent sweets 2 from falling out. Consequently, the sweets 2 that are in the uppermost compartment 21 will fall out through the dispensing opening as shown in FIG. 8.

Hence, it can be seen that in both the embodiment of FIGS. 1-2 and the embodiments of FIGS. 3-7, the interior of the container 3 is provided with guide structure that defines a path for the granular foodstuff 2. The guide structure guides the granular foodstuff 2 towards the dispensing opening 14 when the container 3 is rotated about its longitudinal axis L but prevents granular foodstuff from falling out of the dispensing opening 14 when the container 3 is at a standstill (i.e. when it does not rotate). The granular foodstuff 2 will thus remain at rest when the container does not rotate. In the embodiment of FIGS. 1-2, the guide structure is formed by the screw 17. In the embodiments of FIGS. 3-7, the guide structure comprises the longitudinally extending elevations 27 but also the collar 18 and the braking plate 19 since they contribute to defining the path of the granular foodstuff and contribute to making the granular foodstuff remain at rest when the container 3 is not rotating. The collar 18 and the braking plate 19 may thus also be seen as guides or part of a guide structure. It can be added that, although the collar 18 is located at the dispensing opening 14, it must still be considered an internal guide (an inside guide of the container) since it faces the inside of the container (the interior of the container 3) and is capable of meeting bulk candy that is still inside the container 3.

Reference will now be made to FIG. 9*a* and FIG. 9*b*. The braking plate 19 has a side that faces away from the dispensing opening 14. On the side that faces away from the dispensing opening 14, the braking plate 19 may be provided with a radial guide 23, the radial guide 23 having an extension in a direction perpendicular to the longitudinal axis of the container 3 and intersects the longitudinal axis of the container 3. When it is mounted in the container 3, the radial guide 23 preferably extends at least all the way to one of said longitudinal elevations 27 that form guides. In FIG. 9*a*, it is shown how the braking plate 19 may be provided with grooves 20 such that the braking plate 19 can be locked to the longitudinal elevations 27 that are distributed around the circumference of the inner wall surface 16 of the container 3, for the grooves 20 fit the longitudinal elevations 27. Alternatively, there could be grooves in the longitudinal elevations/rails 27 in which a braking plate 19 may be secured. Of course, it is also conceivable that the braking plate 19 could be secured to the longitudinal elevations 27 in some other way. Embodiments are also conceivable where the braking plate 19 is not at all secured to the longitudinal elevations 27. For example, screws, bolts or other elongate objects could extend through the collar 18 to the braking plate 19 and fix the braking plate 19.

The braking plate 19 is either fixedly secured to at least one of said elevations or arranged to be able to be displaced along said elevations and secured at different distances from the dispensing opening 14. The distance A between the braking plate 19 and the collar 18 (see FIG. 7) may thus be variable. In advantageous embodiments of the invention, the braking plate 19 may thus be attached to or connected to several longitudinal elevations 27 (guides), for example through interaction between grooves 20 and longitudinal elevations 27. If the braking plate 19 is fixed (immovable) in its position, it may be for example glued in a specific position.

If the braking plate 19 can be displaced in the direction of the longitudinal axis of the container 3 such that the distance between the braking plate 19 and the dispensing opening 14 can be varied, this entails an advantage; namely that the size of the compartments 21 can be varied. Different sorts of sweets 2 may come in pieces of different size which in turn means different requirements on the size of the compartments 21. If the sweets/candies are large, the compartments 21 should be more elongate and it may then be appropriate to place the braking plate 19 at a larger distance from the dispensing opening 14. Conversely, if the sweets/candies come in smaller sizes, the distance between the braking plate 19 and the dispensing opening 14 should be decreased. In this way, one and the same dispensing device can be adapted to sweets of different sizes.

The radial guide 23 that is shown in FIG. 91 and FIG. 9*b* entails the advantage that sweets that have been pressed towards the braking plate 19 can be guided towards the periphery when the container 3 rotates. Thereby, the risk that sweets remain at the centre of the braking plate 19 can be reduced. However, embodiments without such a radial guide 23 are also conceivable. Embodiments are conceivable where the radial guide 23 does not pass the centre of the braking plate 19 (which normally coincides with the longitudinal axis of the container 3) but is instead somewhat eccentrically placed or has an interruption at the centre of the plate 19. However, in preferred embodiments, the radial guide has such an extension that it passes the middle point of the braking plate 19. Thereby, it can fulfill its function in an effective way.

It should be understood that, as the container 3 rotates about its longitudinal axis, sweets will move in the axial direction of the container 3, i.e. in a direction that is parallel to or essentially parallel to the longitudinal axis about which the container 3 rotates. This is because the guide or guides 17, 18, 19, 27 is/are arranged to act on the sweets in interaction with gravity to impart this movement to the sweets. The dispensing device 1 is thus designed such that rotation of the container about its longitudinal axis has the effect that the guide or guides interact(s) with gravity to cause the sweets to move in the axial direction of the container 3 and towards the dispensing opening 14.

In FIG. 10, a part of a container 3 according to another embodiment is shown. It should be understood that this container 3 may be provided with a collar 18. In the embodiment according to FIG. 10, another kind of radial guide 23 is shown and the braking plate 19 may also be shaped in another way.

FIG. 11 shows an embodiment in which the braking plate 19 has been provided with an exterior guide 23 that is intended to affect the direction of movement of sweets that fall from the dispensing opening 14. It should be understood that also the container shown in FIG. 11 may be provided with such a collar as shown in for example FIG. 4.

In for example FIG. 5 and FIG. 11, guides are shown as longitudinal elevations 27 that have the shape of essentially flat rails. This is, of course, a conceivable embodiment but a more advantageous embodiment is shown in FIG. 12. FIG. 12 shows an embodiment where the longitudinal elevations 27 have been given such a cross section that the space between the longitudinal elevations 27 does not decrease in a direction radially inwards. In FIG. 12, the distance $L_1$ between the tops/peaks of two adjacent longitudinal elevations 27 is as large as the distance $L_2$ between the bottoms of two adjacent longitudinal elevation 27 (as used herein, the "bottom" of a longitudinal elevation refers to the part of a longitudinal elevation that is closest to the inner surface 16 of the container 3 while the "top" refers to that part of a longitudinal elevation 27 that is radially inmost in the container 3). The longitudinal elevations 27 thus become narrower radially inwards. Since the longitudinal elevations 27 become narrower radially inwards, the distance between adjacent longitudinal elevations 27 remains constant in the radial direction. If this were not the case, it would instead be the space between the longitudinal elevations 27 that became narrower in a direction radially inwards. This could cause sweets 2 to become wedged between the longitudinal elevations 27 instead of falling out through the dispensing opening 14. The embodiment shown in FIG. 12 reduces the risk that this happens. It should be understood that embodiments are conceivable where the distance $L_1$ is even greater than the distance $L_2$. In advantageous embodiments of the invention, the longitudinal elevations 27 are thus shaped such that, in a direction radially inwards towards the longitudinal axis of the container 3, the distance between two adjacent elevations 27 is constant or increasing.

Embodiments are also conceivable where the longitudinal elevations 27 become narrower in a radially inwards direction but where the distance between the longitudinal elevations 27 is yet allowed to decrease. Since the distance does not decrease so much, the risk that sweet will become wedged is still reduced.

FIG. 13 shows an embodiment in which a receiver element 24 has been placed in connection with the dispensing opening 14. The receiver element 24 may, as shown in FIG. 13, have a chute on which sweets/candies that have fallen from the dispensing opening 14 can glide. The chute can be followed by a funnel or other guide. A user can then place a bag for sweets in a place where he or she can be sure that the sweets will arrive.

FIG. 14 shows an embodiment in which a cover/casing 25 has been placed over the dispensing opening to prevent customers in a shop or store from attempting to insert a hand through the dispensing opening 14 to reach candies. The cover 25 is preferably tightly closing. In a lower part of the cover 25, the cover may be provided with a hatch or slot 30 that allows sweets to fall out from the covert 25 but which is placed at such a distance from the dispensing opening 14 and/or is so narrow that it is either difficult or impossible to reach sweets/candies inside the container 3 therethrough. According to a preferred embodiment, the hatch may normally be closed and arranged such that it can be opened only when sweets are fed to or have been fed to it. For example, the hatch may be arranged to be opened automatically, for example in connection with dispensing of sweets by means of synchronization with the rotation of the container 3, or through detection of candies falling on the hatchet or having fallen on the hatch, the hatch possibly being spring-loaded. In such an embodiment, the time during which the hatch is held open is limited such that it is not open for more than a short moment/a few short moments since the feeding out of sweets has been interrupted. It is also possible to arrange a mechanical lever or a button (possibly connected to an electrical motor) or some other control for the hatch, which lever, button or control possibly may be prevented from opening at other times than when sweets are dispensed and/or a short period of time thereafter. Moreover, it may be suitable that this lever, button or control is not arranged to keep the hatch open but only to affect an opening mechanism and that the hatch is closed thereafter without the customer being able to prevent that this happens.

With reference to FIG. 1 and to FIG. 24, the inventive device 1 may optionally be designed such that the container 3 cannot be rotated until a sensor 400 has detected that a specific condition has been satisfied. If this condition is not satisfied, rotation of the container 3 is not permitted and the motor 6 that is arranged to cause rotation of the container 3 cannot be started. The condition could be, for example, that the customer has paid for a quantity of granular foodstuff. Payment can be achieved by, for example, insertion of a coin into a slot that is connected to a sensor which in turn is connected to a control and/or monitoring device 200 that may be arranged to start and stop the motor 6. Payment could also be achieved by means of a card that is connected to a card reader that is capable of communication with the control and/or monitoring device 200. The card reader would then serve as a sensor 400 for detecting the specific condition for permitting rotation. Another condition for allowing rotation of the container 3 could be the presence of a receptacle 350 in a position to receive granular foodstuff from the dispensing opening 14. In particular, it could be that a receptacle 350 has been placed in a position below the dispensing opening 14.

With reference to FIG. 24, the leg 10 of the cradle 9 may be provided with a support 300 where a receptacle 350 may be placed. The support 300 is placed under the dispensing opening 14. The receptacle 350 could be, for example, a bag or box and the receptacle 350 is placed on the support 300 to receive granular foodstuff that is dispensed through the dispensing opening 14. The sensor 400 may be an optical sensor that is placed in a position to detect the presence of a receptacle 350 on the support 300. In other words, the sensor 400 is arranged to detect if a receptacle 350 has been placed in a position below the dispensing opening 14. It should be understood that FIG. 24 is a schematic representation of an arrangement with a sensor 400 and that realistic embodiments may take many different forms. The sensor 400 need does not need to be an optical sensor; anything that can be used to detect the presence of a receptacle on the support 300 and give a signal to the control device 200 could be used. It should be understood that, while the sensor 400 may be unable to detect whether a particular object is suitable as a receptacle 350 or not, it can be capable of determining if an object placed on the support 300 is large enough to be a receptacle or not. As shown in FIG. 24, the sensor 400 is connected to the control and/or monitoring device 200 through a connection 450 that may be a wire but which could also be a wireless connection. The control and/or monitoring device 200 could be a computer that is connected to the motor 6 such that it can control the motor 6. The control device 200 may be connected to the motor 6 through a connection 460 which could be a wire or a wireless connection. The inventive device 1 for dispensing granular foodstuff could be arranged such that the container 3 cannot be rotated until a sensor 400 has sent a signal indicating that a necessary condition is satisfied and a customer has activated the switch 12.

A sequence of operation could then be as follows. A customer who wishes to obtain a quantity of granular foodstuff (e.g. bulk candy) from the container 3 places a box, bag or other receptacle 350 in a position below the dispensing opening 14. A sensor 400 (for example an optical sensor) detects that something that is large enough to be a receptacle 350 has been placed in a position below the dispensing opening 14, for example on the support 300. This means that a receptacle 350 is now in a correct position to receive granular foodstuff dispensed through the dispensing opening 14. The sensor 400 emits a signal to the control and/or monitoring device 200 which then decides that rotation of the container 3 is permitted. Thereafter, the customer may cause the container 3 to rotate, for example by using a switch such as the switch 12 shown in FIG. 1.

If the sensor 400 has not indicated to the control and/or monitoring device 200 that a receptacle is in a correct position, the control and/or monitoring unit will not start the motor 6, even if the customer uses the switch 12. The container 3 will then not be rotated. The gear wheel 7 will then act to lock the container 3 against rotation since the gear wheel 7 engages the gear ring 8. When the motor 6 does not operate, the motor 6 and the gear wheel 7 will thus lock the container 3.

Alternatively, embodiments are conceivable where the container 3 is rotated not by a motor 6 but manually. In such embodiments, a separate locking device (not shown) could be used in connection with a sensor 400 and a control and/or monitoring device 200 to lock the container against rotation until as signal emitted from the sensor 400 to the control device 200 indicates that rotation of the container 3 is permitted.

It should also be understood that the particular driving arrangement of FIG. 1 with a gear wheel 7 and a gear ring 8 is not the only possible driving arrangement. The motor 6 could be arranged to rotate the container 3 by means of some other transmission. For example, the transmission could be a belt drive or any other transmission that is suitable. The motor 6 may thus be arranged to cause rotation of the container 3 in a number of different ways that will be obvious to those skilled in the art.

In FIG. 24, the sensor 400 is shown as connected to the motor 6 via the control and/or monitoring device 200. It should be understood that this particular arrangement is optional and that the sensor 400 may be directly connected to the motor 6 in such a way that a signal emitted by the sensor 400 directly affects the motor 6 itself such that the motor 6 can be started. Conversely, it should be understood that the switch 12 may optionally be connected to the motor 6 via a control and/or monitoring device 200.

If a sensor 400 is used as described above, this may reduce the risk that granular foodstuff is dispensed before a receptacle 350 has been placed below the dispensing opening 14. However, it should be understood that the use of a sensor 400 as described above is optional and that embodiments without such an arrangement are possible. If an arrangement with a sensor 400 is used as explained above, such an arrangement could take many different forms. For example it should be understood that the support 300 in FIG. 24 is optional. Still, if a support 300 is used, this entails the advantage that a correct position for the receptacle 350 is defined. The sensor 400 could then be arranged to sense if an object large enough to be a receptacle has been placed on the support 300.

It should be understood that the idea of using a sensor that is arranged to detect whether a specific condition has been satisfied (for example "receptacle in position") could be used independently of how the inventive device is otherwise designed. For example, it could be used together with any kind of dispensing device that comprises a container for granular foodstuff and where the container has a dispensing opening 14 and some kind of arrangement for dispensing granular foodstuff, i.e. feeding granular foodstuff from the container and out through the dispensing opening. For example, it could be used in connection with a dispensing device using a screw that rotates in relation to the container.

In order to prevent that sweets that are stored in the container 3 be contaminated by contagion from customers, for example by customers coughing or sneezing as they choose their sweets or pick the sweets with their hands, to keep the sweets free from litter and to protect the sweets in the container 3 from dehydration, it is an advantage if, in preferred embodiments, the container is tightly closing all around and at both its ends 4, 5. This can be accomplished if the container 3 is made from an impermeable material or arranged inside an external casing that is tightly closing such that the container thereby comes to be enclosed inside a tightly closing casing.

FIG. 14 also indicates how also the second end of the container 3 may possibly be provided with a gear ring 8' which can fulfill the same function as the gear ring 8 at the first end of the container 3. A gear wheel driven by a motor may thus act on the gear ring 8'. For example, gear wheels acting on the gear rings 8, 8' could be driven by a common motor.

In the embodiments shown in for example FIG. 5 and FIG. 11, guides in the shape of elevations may be formed by longitudinally extending rails. In other embodiments, the container 3 may be provided with creases which, on the inner wall surface 16 of the container 3, form said longitudinal elevations 27 that serve as guides.

FIG. 15 also shows an embodiment in which the casing of the container 3 has been creased/wrinkled such that two creases form elevations on the inner wall surface 16 of the container 3, thereby forming guides 27 (on the exterior side 15 of the container, the creases are visible as grooves/indentations. It can be noted that the creases/wrinkles that have been formed in the container 3 have a height that varies along the longitudinal axis of the container. At the first end 4 of the container 3, the creases/wrinkles are faintly formed such that the longitudinal elevations 27 that form guides extend only a short distance radially inwards. At the other end 5 where the longitudinal extension guides 27 fulfill their most important function, the creases/wrinkles are more pronounced such that the longitudinal elevations 27 extend further radially inwards. The same principle may of course apply also to other guides, for example the guides 27 shown in FIG. 11.

FIG. 16 shows an embodiment of the container 3 in which the guides shaped as longitudinal elevations 27 have been formed as creases in the container 3 in the same way as in the embodiment according to FIG. 15. However, in FIG. 16, there are four longitudinal elevations 27 while the embodiment of FIG. 15 has only two such guides. It should be understood that the creases/wrinkles that form guides in the shape of longitudinal elevations 27 in the embodiments of FIGS. 15 and 16 may have such a shape that the distance between two adjacent longitudinal elevations 27 does not decrease in a direction radially inwards. The guides may thus be shaped according to the principle explained in connection with FIG. 12.

An embodiment according to FIG. 15 or FIG. 16 can be accomplished, for example, by wrinkling a metal sheet, bending it into a cylinder and welding the edges.

FIG. 17 shows an exploded view of an embodiment with a creased/wrinkled container 3 where the depth of the creases is almost nil at the first end 4 of the container 3 and increases in a direction towards the second end 5. A braking plate 19 is provided with grooves 20 in order to be mated with the longitudinal elevations 27. A collar 18 has been arranged as a separate part that can be fixed to the container 3 (for example by adhesive bonding or welding). A gear ring 8 can be mounted on the outside of the container 3. FIG. 18 shows how the components shown in FIG. 17 have been assembled to a unit. Here, it can also be seen how a gear ring 8' has been arranged at the second end 5 of the container 3.

Another aspect of the invention will now be explained with reference to FIG. 19 and FIG. 20. The invention also relates to an insert which is designed such that it can be inserted in a dispensing device 1 for granular foodstuff 2. This insert comprises an elongate container 3 which is at least partially filled with granular foodstuff 2 and extends from a first end 4 to a second end 5 along a longitudinal axis. On its inner wall surface 16, the container 3 is provided with longitudinal elevations 27 that form guides. A braking plate 19 is mounted at a distance from the second end 5 and engages (meshes with) at least some of said longitudinal elevations 27 in such a way that granular foodstuff 2 can pass the braking plate 19 in an area between the braking plate 19 and the inner wall surface of the container 3.

FIG. 19 shows the insert which comprises a container 3 when the container 3 is in a position where it is ready to be inserted into an exterior casing 26 which in FIG. 19 is shown as provided with a collar 18. Embodiments are also conceivable where the container 3 of the insert itself is provided with a collar 18. The container 3 is filled with sweets and a braking plate 19 is mounted in the container 3 as previously described.

The outer casing 26 may be a part of a dispensing device for sweets (granular foodstuff) and may be placed in for example such a cradle as shown in FIG. 1. The outer casing 26 may also be provided with a gear ring such that the outer casing can be rotated by a drive motor 6 and a gear wheel 7 (or it can be arranged to be rotatable in some other way). The insert that comprises the container 3 can be made from a cheap throw-away material, for example cardboard or some cheap plastic material.

The insert with its container 3 can be made and filled separately away from the shop or store where the bulk candy is sold. It can suitably be provided with a transport sealing that protects the goods during freight. The transport sealing may comprise caps/lids or coverings of paper or cardboard that covers the ends 4, 5 of the container 3. When the insert reaches the store, the transport packaging (if any is used) is removed and the container 3 is loaded like a cartridge into the outer casing 26. The insert and the outer casing 26 will then together form a dispensing device for sweets. By means of such an insert, the dispensing device can be filled with sweets/candies in a way that is both quick and practical and which moreover is hygienic. It should be understood that the container 3 that is used in the insert is preferably designed such that it is tight-closing all around and at both its ends such that the insert that is delivered is protected against both contagion and dehydration of the sweets. It should also be understood that, when the container 3 has been loaded into the outer casing 26, it is preferably tightly closed at its upper, first end 4, i.e. at its rear end, unless the outer casing 26 is designed in such a way that it tightly closes the container 3.

It should also be understood that an insert with a guide in the shape of a screw 17 as shown in FIG. 2 is also conceivable. In such a case, the use of a collar 18 could be dispensed with.

The insert could thus also be described in terms of a container having one or several guides that, when the container is inclined relative to the horizontal, guide granular foodstuff inside the container towards the dispensing opening when the container is rotated about its longitudinal axis but cause the granular foodstuff to remain at rest when the container is at a standstill (i.e. when it does not rotate).

FIG. 20 shows how the various parts in FIG. 19 have been put together to a coherent whole.

In the above explained embodiments, the container 3 has been shown as a container with a circular cylindrical cross-section. It is believed that this is the most suitable shape that will give an even output and reduces the risk of mechanical damage to the sweets. However, other shapes for the container 3 are also conceivable, for example an octagonal cross-section as shown in FIG. 21. Other cross-sections are also conceivable, for example square.

FIG. 22 shows how several inventive dispensing devices have been arranged in groups on a common carrier 28. Each separate dispensing device may contain its own particular variety of sweets and sweets/candies of various sizes may be placed in different dispensing devices.

Finally, FIG. 23 shows yet another advantageous embodiment. In the embodiment of FIG. 23, at least one weighing device 100 has been connected to the cradle 9 in which the container 3 rests. The weighing device 100 is arranged to detect the weight of the container and the weight of the granular foodstuff within the container can thereby be detected by the weighing device 100. The weighing device 100 may be arranged such that a human operator may read a value of the weight directly on the weighing device itself. However, the weighing device 100 may advantageously be connected to a control and/or monitoring device 200. The control and/or monitoring device 200 may be, for example, a computer. FIG. 23 shows how the weighing device 100 is connected by wire 150 to the control and/or monitoring device 200 but the connection could of course also be a wireless connection. One or many weighing devices 100 may be used. In FIG. 23, two weighing devices are shown. A weighing device for the container 3 may advantageously be placed in connection with a bearing 50 for the container 3 in such embodiments where the container 3 is resting on bearings 50 in the cradle 9. When granular foodstuff 2 is dispensed from the container, the weighing device 100 (or weighing devices 100) will detect that the weight of the container 3 decreases. Since the weight of the empty container 3 is known, the control and/or monitoring device 200 can determine when the container 3 is empty or close to be empty. The control and/or monitoring device 200 may then send an alert that indicates that the container 3 needs to be refilled. The weighing device(s) 100 could of course be placed in some other position than the one shown in FIG. 23. For example, a weighing device 100 could be placed under the foot 11 shown in FIG. 1. A weighing device 100 could also be placed below the dispensing opening 14 to weigh each separate quantity of granular foodstuff dispensed through the dispensing opening 100. The weighing device could then be placed in connection with a support on which customers place bags to receive dispensed granular foodstuff. The weighing device 100 would then make it possible for the control device 200 to determine the total amount of dispensed foodstuff and thereby calculate the amount of foodstuff remaining in the container. The result of this calculation can be used to determine the need for refill and/or to predict when refill will be needed the next time. The control and/or monitoring device 200 may include such software that, when the detected weight is less than a predetermined value, the control and/or monitoring device 200 sends a message that a refill is needed. This message could be, for example, an e-mail to a recipient that may be a supplier of granular foodstuff.

The use of a weighing device 100 entails certain advantages. The risk that an empty container 3 will be left without refill is significantly reduced. It becomes easier to predict when a container must be refilled (or when a new insert loaded with candy will be needed). Manual surveillance of the container(s) 3 becomes unnecessary. Handling of the granular foodstuff may thus be made more rational.

It should be understood that the control and/or monitoring device 200 that is connected to a weighing device 100 may or may not be the same control and/or monitoring device 200 that is used to control the motor 6 (in such embodiments where a control device 200 is connected to the motor 6).

It should be understood that the use of a weighing device 100 connected to or arranged to weigh the container 3 and/or its contents could be used in connection with any kind of dispensing device for granular foodstuff that includes a container 3 for granular foodstuff and some kind of arrangement for dispensing granular foodstuff through a dispensing opening 14. For example, such a weighing device 100 could be used in connection with a dispensing device using a screw that rotates in relation to the container.

For the embodiments using guides in the shape of longitudinally extending elevations or rails 27, it should be understood that the inventive device also fulfills another important function, namely to reduce the risk that separate pieces of candy/sweets stick together and form lumps. When the container 3 rests in the cradle 9, the longitudinal axis L of the container 3 being inclined relative to the horizontal plane and the container 3 rotates about its longitudinal axis L, there is at least one longitudinal elevation/rail 27 on the inner wall surface 16 of the container that first lifts bulk candy as it rotates about the longitudinal axis L. When the longitudinally extending elevation/rail 27 reaches a certain angular position, bulk candy that has been lifted by the longitudinally extending elevation 27 will fall down and hit against the inner wall surface 16 of the container 3. This will tend to break up lumps of bulk candy that have been formed when pieces of sweets/candy have become stuck together. In this way, the invention can counteract the formation of lumps. Consequently, the longitudinally extending elevation(s) 27 may also counteract the formation of lumps. The longitudinal elevation(s) 27 may extend into an area between the braking plate 19 and the collar 18 to form one or several dividing walls that divide the separate compartments 21 from each other in the circumferential direction. However, embodiments are also conceivable where elements separate from the longitudinally extending elevations 27 are used to separate the compartments 21 from each other.

Of course, the dimensions of the inventive dispensing device may vary according to the requirements. However, in many realistic embodiments, the container 3 may have an axial extension of 30-100 cm and an outer diameter in the range of 15-40 cm. In many realistic embodiments, guides that take the shape of longitudinally extending elevations 27 (as in for example the embodiment of FIG. 5) may have an extension in the radial direction of 2-10 cm. In one embodiment that has been tested experimentally and has proven itself in practical tests, the container 3 has an axial length of about 56 cm and an outer diameter of 24 cm. In this embodiment, the guides comprised longitudinally extending elevations 27 that became narrower in a direction radially inwards. In the radial direction, longitudinal elevations 27 extended about 5 cm inwards. In the embodiment of FIGS. 1 and 2, the thread of the screw 17 may have a height (i.e. an extension in the radial direction of the container) of, for example, 3-35 cm when the container 3 has an outer diameter up to 40 cm.

Concerning the choice of material for the container, it may be suitable due to hygienic reasons to make the container in sheet metal, preferably a sheet of stainless steel. Alternatively, plastic materials could also be used since plastic materials are also hygienic in this context. Parts of the dispensing device, for example a braking plate 19, may be made of a transparent plastic material however, such that the customers can see the sweets inside the dispensing device.

Irrespective of whether a screw guide 17 or guides in the shape of longitudinal elevations 27 such as rails or creases are used, these guides, are fixed relative to the container, i.e. they rotate together with the container 3. The same is also true for other guide structure such as the collar 18 and the braking plate 19.

For all embodiments where the guides comprise longitudinally extending elevations 27, it should be understood that these guides do not necessarily have to extend all the way from the first end 4 to the second end 5. Instead, they could extend along only a part of the way from the first end 4 to the second end 5. For example, they could extend from the dispensing opening 14 towards the first end 4 but only by a length that constitutes 10%-50% of the longitudinal extension of the container.

Since the guide or guides 17, 18, 19, 27 do not move or rotate relative to the container but instead rotate together with the container, relative movement that could damage the sweets can be avoided. That the guide or guides is/are fixed in relation to the container 3 consequently entails a significant advantage.

The invention claimed is:

1. A device for dispensing granular foodstuff, the device comprising:

a container which at an end of the container has a dispensing opening through which granular foodstuff can leave the container, the container having an inside that is provided with at least one guide for the granular foodstuff, wherein the container is arranged so as to be rotatable about a longitudinal axis (L) of the container, the longitudinal axis being inclined relative to the horizontal plane by an angle in the range of 3°-80°, and in that said at least one guide is fixed in relation to the container and comprises a plurality of elevations on an inner wall surface of the container, the elevations extending essentially in a direction of the longitudinal axis of the container and dividing an area around the dispensing opening into at least two compartments that are separated from each other, and where the container has a collar in the area around the dispensing opening, the collar extending radially inwards towards the longitudinal axis of the container and said elevations are arranged in the container such that the granular foodstuff is guided in a direction towards the dispensing opening when the container rotates about the longitudinal axis (L) but remains at rest when the container is at a standstill.

2. The device according to claim 1, wherein the longitudinal axis is inclined relative to a horizontal plane by an angle in the range of 10°-25°.

3. The device according to claim 1, wherein said at least one guide is a screw/worm that is fixed in relation to the container.

4. The device according to claim 1, wherein said elevations are formed by longitudinally extending rails.

5. The device according to claim 1, wherein the container is provided with creases that form said elevations on the inner wall surface of the container.

6. The device according to claim 4, wherein a braking plate is arranged inside the container at a distance from the dispensing opening, the braking plate partially blocking a path towards the dispensing opening such that, in the area between the collar and the braking plate, said elevations on the inner wall surface of the container form separate compartments for the granular foodstuff.

7. The device according to claim 6, wherein the braking plate has a side that faces away from the dispensing opening and wherein, on the side that faces away from the dispensing opening, the braking plate is provided with a radial guide that has an extension in a direction which is perpendicular to the longitudinal axis of the container and intersects the longitudinal axis of the container.

8. The device according to claim 7, wherein the radial guide extends at least all of a way to one of said elevations.

9. The device according to claim 7, wherein the braking plate is either fixedly secured to at least one of said elevations or arranged to be able to be displaced along said elevations and secured at different distances from the dispensing opening.

10. The device according to claim 1, wherein said elevations are shaped such that, in a direction radially inwards, towards the longitudinal axis of the container, the distance between two adjacent elevations is constant or increasing.

11. The device according to claim 1, wherein a weighing device is arranged to detect a weight of the granular foodstuff within the container.

12. The device according to claim 11, wherein the weighing device is connected to a control and/or monitoring device.

13. The device according to claim 1, wherein the device comprises a motor which is arranged to cause rotation of the container and a switch that is connected to the motor in such a way that the motor can be started by the switch, and wherein the device further comprises a sensor which is arranged to detect if a specific condition has been satisfied and wherein the sensor is connected to the motor such that the motor cannot be started by the switch unless the sensor has first emitted a signal indicating that said specific condition has been satisfied.

14. The device according to claim 13, wherein the sensor is arranged to detect if a receptacle for granular foodstuff has been placed in a position below the dispensing opening such that the motor cannot be started unless the sensor has first emitted a signal indicating that a receptacle has been placed in a position below the dispensing opening.

15. A device for dispensing granular foodstuff, the device comprising:

an elongate container in which foodstuff to be dispensed can be placed, the container having a longitudinal axis (L) extending from a first end to a second end and a dispensing opening at the first end through which the granular foodstuff can be dispensed; and a cradle in which the container is supported, wherein, when the container rests in the cradle, the longitudinal axis of the container is inclined relative to the horizontal plane and the container can be rotated about the longitudinal axis (L), and wherein the container has an inner wall surface which is provided with at least one guide in a shape of a longitudinal elevation that extends in a direction parallel to the longitudinal axis (L) of the container such that rotation of the container causes the granular foodstuff inside the container to be first lifted by the at least one guide and then fall down, and wherein the container comprises a braking plate upstream of the dispensing opening, wherein said braking plate is arranged to block a part of a path towards the dispensing opening but allows the foodstuff to pass between the braking plate and the inner wall surface of the container, and wherein the container has a collar in the area around the dispensing opening which the collar counteracts that the granular foodstuff falls out of the container when the container is at a standstill, and wherein an area between the collar and the braking plate is divided in a circumferential direction into at least two separate compartments such that rotation of the container about the longitudinal axis (L) will cause the granular foodstuff in at least one compartment to fall out of the dispensing opening while the granular foodstuff from a part of the container upstream of the braking plate falls into at least one other compartment.

16. The device according to claim 15, wherein the container comprises at least two guides in the shape of longitudinal elevations that extend in a direction parallel to the longitudinal axis (L) of the container and extend to the collar such that the guides form dividing walls for the separate compartments.

17. The device according to claim 15, wherein a weighing device is arranged to detect the weight of the granular foodstuff within the container.

18. The device according to claim 17, wherein the weighing device is connected to a control and/or monitoring device.

19. The device according to claim 15, wherein the device comprises a motor which is arranged to cause rotation of the container and a switch that is connected to the motor in such a way that the motor can be started by the switch, and wherein the device further comprises a sensor which is arranged to detect if a specific condition has been satisfied and wherein the sensor is connected to the motor such that the motor cannot be started by the switch unless the sensor has first emitted a signal indicating that said specific condition has been satisfied.

20. The device according to claim 19, wherein the sensor is arranged to detect if a receptacle for granular foodstuff has been placed in a position below the dispensing opening such that the motor cannot be started unless the sensor has first emitted a signal indicating that a receptacle has been placed in a position below the dispensing opening.

* * * * *